US006137512A

United States Patent [19]

Higuma et al.

[11] Patent Number: 6,137,512

[45] **Date of Patent: *Oct. 24, 2000**

[54] INK CONTAINER

[75] Inventors: Masahiko Higuma, Tohgane; Hiroshi Sugitani, Machida; Masami Ikeda, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/498,870

[22] Filed: Jul. 6, 1995

[30] Foreign Application Priority Data

Jul. 6, 1994 [JP] Japan ..... 6-155076
Jul. 6, 1994 [JP] Japan ..... 6-179505

[51] Int. Cl.[7] ..... B41J 2/175
[52] U.S. Cl. ..... 347/86
[58] Field of Search ..... 347/86, 87, 85

[56] References Cited

U.S. PATENT DOCUMENTS 4,340,897 7/1982 Miller .
5,421,658 6/1995 Suzuki et al. .

FOREIGN PATENT DOCUMENTS 5239393 2/1995 Australia ..... B41J 2/175
0488829 6/1992 European Pat. Off. ..... B41J 2/175
0529625 3/1993 European Pat. Off. ..... B41J 2/175
0562733 3/1993 European Pat. Off. .
0536980 4/1993 European Pat. Off. .
0571151 11/1993 European Pat. Off. .
0577439 1/1994 European Pat. Off. ..... B41J 2/175
0658431 6/1995 European Pat. Off. ..... B41J 2/175
3732797 4/1988 Germany ..... B41J 3/04
02034353 2/1990 Japan .
4290752 10/1992 Japan ..... B41J 2/175
05008405 1/1993 Japan .
05096742 4/1993 Japan .
05104735 4/1993 Japan .
15839 1/1994 Japan ..... 347/85
06079882 3/1994 Japan .
WO 91/04861 4/1991 WIPO .

*Primary Examiner*—John Barlow
*Assistant Examiner*—Craig A. Hallacher
*Attorney, Agent, or Firm*—Fitzpatrick, Cella, Harper & Scinto

[57] ABSTRACT

An ink container for containing ink to be supplied to an ink jet head, includes fibrous material; an ink discharge port for discharging the ink to the ink jet head; a portion for containing the fibrous material at least adjacent the ink discharge port; wherein the fibrous material is deformed within a degree of elasticity, forming a plurality of intersections in different directions, and contained in the containing portion.

13 Claims, 16 Drawing Sheets

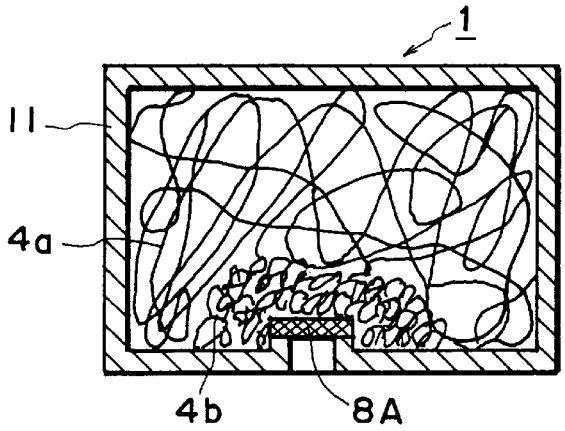
FIG. 8
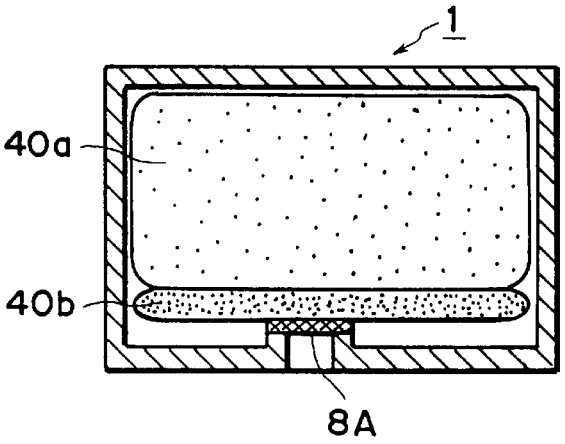
FIG. 9
FIG. 10A
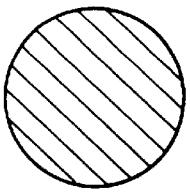
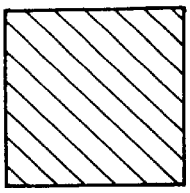
FIG. 10B
FIG. 10C
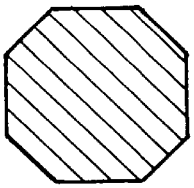
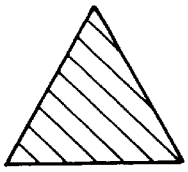
FIG. 10D
FIG. 10E
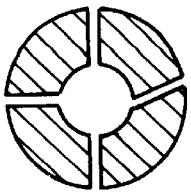
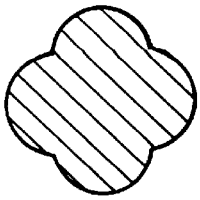
FIG. 10F
FIG. 10G
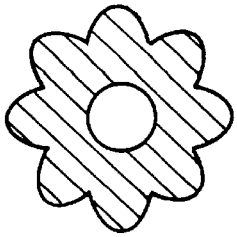
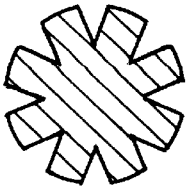
FIG. 10H

INK CONTAINER

FIELD OF THE INVENTION AND RELATED ART

The present invention relates to an ink container, in which fiber is placed as an ink retaining member for retaining ink, an ink jet apparatus employing such an ink container, and a manufacturing method for such an ink container.

As for a conventional ink container (whether it is integrated with a recording head, or it is exchangeable independently from the head) having been put to practical use for ink-based recording, there is a type of ink container filled with a single or a plurality of sponge pieces.

The sponge piece is placed in the ink container to prevent the ink from leaking out of a liquid ejecting portion such as a nozzle provided in a recording means. More specifically, it is placed there to use as sponge; the capillary force is used as back pressure for impeding the ink low directed toward the recording means. This back pressure creates negative pressure, relative to the atmosphere pressure, in the ejecting portion, and hereinafter, it will be referred to as "negative pressure".

Generally speaking the diameter of a sponge pore falls within a range of 80–200 $\mu$m, and the sponge material itself occupies a substantial portion of the internal volume of the container. Therefore, as long as the sponge is present within the ink container, little can be expected from an attempt made to increase the amount of a given ink container, that it is, an attempt made to improve the space usage efficiency for the ink container.

Further, even when an effort is made to modify the structure of the ink container so that the amount of the ink, which otherwise ends up being left unused in the ink container, is reduced, the capillary force of the like of the sponges places an inherent limit to the reduction.

The porous material employed as the ink retaining member is formed in advanced in a predetermined shape; therefore, when it is compressed into the ink container, the contour of the porous material does not perfectly conform to the internal surface of the ink container, leaving gaps between the two, which is liable to fail to create the capillary force expected there. Further, urethane form, a typical porous material, is not compatible with certain types of ink, which limits the number of ink choices to be stored in the container.

Therefore, the inventors of the present invention made a proposal in a Japanese Laid-Open Patent Application No. 34353/1990 in which the ink supplying efficiency was improved by rendering smaller the sponge pore diameter adjacent to the ink supplying port than in the middle of the ink container. The inventors of the present invention disclosed another invention in a Japanese Laid-Open Patent Application No. 8405/1993, in which a bundle off parallelly bound straight strands of fiber was disposed next to the ink supplying port, which was effective for improving the ink supplying efficiency and reducing the amount of the unusable ink.

There are fiber-based structures other than those described above: for example, the structures disclosed in Japanese Laid-Open Patent Application Nos. 96742/1993 and 104735/1993, in which the direction of the ink movement was changed. In the former invention, a bundle of fiber strands is disposed in contact with the sponge piece, in such a manner than when the ink container is in use, the bundle of fiber strands extends from the bottommost portion to the ink supply port disposed above, whereby the amount of the unusable ink which otherwise ends up remaining in the bottom portion of the ink container is reduced. In the latter invention, the entire internal space of the ink container is filled with sponge, and a bundle of fiber strands is disposed within a portion projecting from the ink container, wherein this bundle of fiber strands constitutes an ink supply passage for supplying the ink to the sponge disposed adjacent to the filter of a recording head.

As described above, the main stream inventions regarding the internal structure of an ink container presumes the presence of the sponge; therefore, they have not reduced substantially the amount of the ink retained unusably in the sponge or have not solved the problem that the ink capacity of the ink container is reduced by the presence of the sponge.

On the other hand, a Japanese Laid-Open Patent Application No. 79882/1994 (corresponding to European Appln. 562,733) discloses A structures in which strands of fiber extending vertically (in the direction of the gravity) are disposed within the ink container to occupy no more than 20% of the internal space of the container so that the ink capacity of the ink container is substantially increased, and also, the ink supplying efficiency is improved. However, in this situation, only a small amount of straight fiber, or the strands of fiber, are arranged merely in one direction.

This Laid-Open Patent Application No. 79882/1994 also discloses a modification, in which nonwoven fabric of polyester, polypropylene, or the like is filled in layers in the ink container. This modification is not different from the original in that it suffers from the problems of the conventional ink container.

Through extensive studies of the inventions described in the forgoing, the inventors of the present invention discovered that the structures disclosed in these inventions barely provided an ink retaining capability, and the strands of fiber collected together in a manner of being bundled as the ink was filled. As a result, the ink was concentrated around the ink supply port, deteriorating the efficiency with which the ink was fed out of the ink container, and also, it was impossible to create stably the negative pressure, which was an important factor in the field of ink jet recording.

SUMMARY OF THE INVENTION

The primary object of the present invention is to solve new problems, that is, the insufficient ink deliver created due to the reduction in the overall ink retaining capability of an ink container, resulting from the decrease of the intervals among the strands of fiber employed as the ink retaining material, which occurs while the ink is filled.

Another object of the present invention is to provide an ink container in which the ink retaining capacity is increased by means of improving the arrangement of the fiber that occupies the inter space of the ink container, wherein this fiber strands contact the internal walls of the ink container, and the way the fiber strands contact each other.

During the making of the present invention attention was given to a different view point; there is an ink flowability difference between the inner portion of the ink container and the portion next to the container wall. In other words, the relationship between the ink flowability, and the material for the ink container wall and the fiber strand, which had not been studied formerly, was studied. As a result, the present invention could provide a preferably relationship among the properties of the ink (in particular, pigment-based ink) to be used and the fiber material.

On the other hand, the studies by the inventors of the present invention disclosed that as the influence from the fiber itself, there were changes in properties related to the fiber strand diameter. Thus, the second object of the present invention is to provide an ink container in which this properties change is effectively applied.

Being guided by this second object, the present invention provides a preferable ink container, in which a fibrous member constituted of fiber strands with preferable properties in placed across, and in contact with, a filter disposed on the head or container side; more preferably, an ink container, in which a preferable relationship is provided between the diameter of the fiber strands occupying the major portion of the internal volume of the ink container, and the diameter of the fiber strand occupying the ink supply port side (head side), that is, the outward side, of the internal space of the ink container; and an ink container, in which the resistance of the fiber itself constituting the major portion of the ink flow resistance can be eased.

Another object of the present invention is to provide an ink container manufacturing method, in which a type of fiber strand, which is compatible, in terms of shelf life, with the ink to be used, and is placeable, as the ink retaining member, in the container main body, in such a manner that does not limit the choices of usable ink, can be employed, and simply placed in the container main body.

In order to realize such a manufacturing method, the present invention proposes such a structure in which a region containing the fibrous material is provided at least on the ink supplying side of the ink container, wherein the fiber strand within the fibrous material is deformed within the limit of the elasticity of the fiber material, and is caused to extend in various directions so as to form complex multiple intersections.

With the presence of the above described structure, that is, the presence of the multiple fiber strand intersections and the elastic deformation of the fiber strand, it is possible to prevent the gap between the adjacent fiber strand portions, of fiber strands, from being reduced by the properties of the ink as the ink is filled.

The present invention also proposes an ink container structure in which a region containing the fibrous material is provided at least on the ink supply side, wherein the material for the container wall and the material for the fiber strand satisfy the same requirements.

According to the structures described above, the properties of the container wall can be matched with the ink flowability within the fibrous member placed in the ink container; therefore, it is possible to prevent such a phenomenon that occurred in the past that is, the phenomenon that the ink flow along the container wall became excessively different from the ink flow within the center portion of the container, disturbing thereby the flow of the ink or air, and as a result, the amount of the ink left unused increased, or the ink consumption fluctuated.

Also, the present invention proposes, as the manufacturing method for the ink container comprising the container main body filled with the fibrous member capable of retaining the ink, to guide the fiber strand into the container main body as the fiber strand is continuously produced using a fiber strand manufacturing apparatus. With the employment of this method, the fiber and ink container can be manufactured through a continuous operation, making it possible to eliminate the storage facility or the like for the fiber.

The present invention propose, as another manufacturing method for the ink container comprising the container main body containing the fibrous member capable of retaining the ink, a method in which the fiber strand is formed in advance into a belt of fibrous aggregate is folded into the container main body. With the employment of this proposals, it is possible to place reliably preventing the fiber strand from scattering.

Further, the present invention proposes to place in the container main body a predetermined number of fibrous aggregate pieces constituted of the aforementioned aggregated fiber strand. In this case, their number is varied depending on the type of the ink container in order to match the ink container type.

The present invention also proposes, as a form of the fiber strand arrangement in the container main body, to pack in advance the fiber strand in an ink-permeable pouch, and then, place a predetermined number of the pouches filled with the fiber stand in the container main body. When this method in employed, the fiber strand can be reliably placed in the container main body within being scattered.

It should be noted here that using the polyolefinic material as the fiber strand material is more preferable; in this case, it is possible to give the fiber strand compatibility, in terms of shelf life, with various types of ink, for example, alkaline ink, and also, to stabilize the structure of the fibrous aggregate using the thermoplastic properties of the material.

It is also preferable to place two or more types of fiber strands, which are different in external diameter or sectional configuration; in this case, it is possible to give the fiber strand an optimum ink retaining capability correspondent to its position within the container main body.

Further, as another manufacturing method for an ink container comprising the container main body containing the fibrous member capable of retaining the ink, the ink may be placed in the container main body before the fiber strand is placed therein. Such a manufacturing method allows some flexibility in the order of the manufacturing steps.

Further, the present invention proposes, as another method for the ink container, to increase, when the ink is placed in the container main body, the amount of the ink solvent that is expected to evaporated while the ink is placed in the container main body.

In this case, the ink solvent may be placed in the container main body before the fiber strand is placed in the container main body.

With the employment of such a manufacturing method, it is possible to prevent the ink from being denatured, to adjust the fiber strand arrangement, in the ink solvent, and to improve the wettability of the fiber strand surface to the ink.

These and objects, features an d advantages of the present invention will become more apparent upon a consideration of the following description of the preferred embodiments of the present intention taken in conjunction with the accompanying drawings.

BRIEF DESCRIPTION OF THE DRAWINGS

FIG. 8 is a schematic drawing that describes how the ink container functions when it employs two types of fiber strands with a different diameter.

FIG. 9 is a schematic drawing that describes how the ink container functions when it employs a negative generating member other than the one employed in the ink container illustrated in FIG. 8.

FIG. 10(*a–h*) are sectional views of the various fiber strands in accordance with the present invention.

DESCRIPTION OF THE PREFERRED EMBODIMENTS

Hereinafter, the embodiments of the present invention will be described with reference to the drawings.

Figure 1:
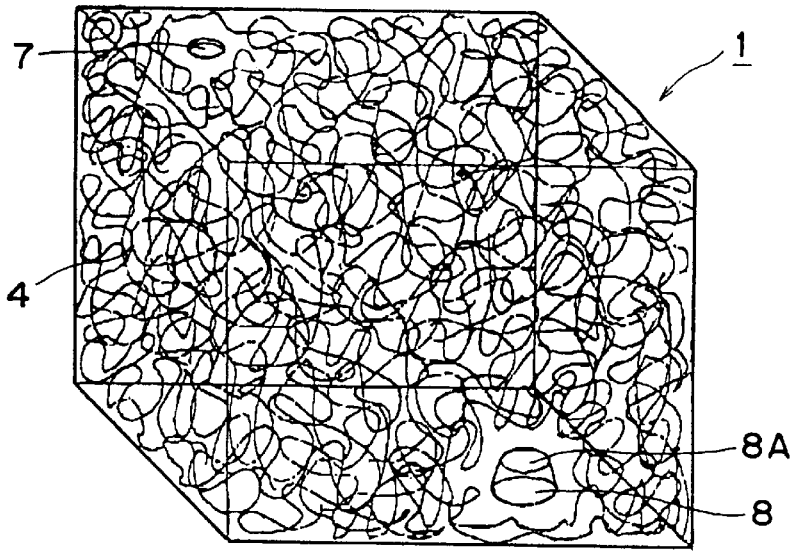
FIG. 1 is a schematic perspective view of an embodiment of ink cartridge in accordance with the present invention, depicting its structure.
Figure 2:
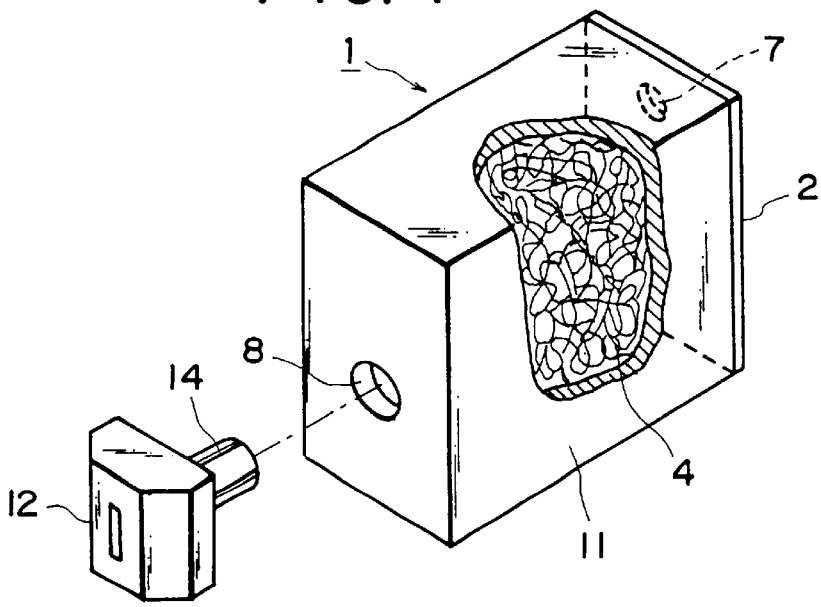
FIG. 2 is a perspective view depicting how the ink cartridge illustrated in FIG. 1 and an ink jet head are connected.

FIG. 1 is a schematic perspective view of the first embodiment of the ink container in accordance with the present invention, and FIG. 2 is a partially cutaway perspective view that depicts how the ink container illustrated in FIG. 1 is connected to an ink jet head.

The ink containers illustrated in these drawings are of a cartridge type, that, is a replaceable type that can be installed into, or removed from, an ink jet apparatus. A cartridge 1 is filled with fiber (fibrous material) as a negative pressure generating material. The fibrous member 4 is constituted of a large number of polypropylene fiber strands, which are 100 μm in diameter and several centimeters to 10 cm in length, being filled in the internal space f the ink container so as to intersect with each other three-dimensionally while forming random curvatures. The amount of the fiber strands filled in the cartridge 1 having an internal volume of 400 cc is approximately four grams. The fibrous member 4 may be constituted of a single strand of fiber long enough to fill the internal space of the ink container by itself, or a plurality of fiber strands.

The filling ratio of the fibrous material in accordance with the present invention, relative to the internal space in which the fibrous material is to be filled, is optionally as long as it effects a plurality of fiber strand intersections, but it is preferable to be no less than 10% and no more than 35%, more preferably, no less than 15% and no more than 25%. This is because these preferable ranges afford a preferable ratio between the internal space fillable with the ink and the amount of the consumable ink therefrom.

A container 11 constituting the causing of the ink cartridge 1 is formed of polypropylene, which is the same material used for the fibrous member 4. One of the walls of the container 11 is provide with an ink supply passage 8. One of the openings of the ink passage 8 faced outward, and the other end faces inward and is fitted with a filter 8A. The filter 8A is in contact with the fibrous member 4, maintaining a proper contact pressure. Another wall of the container 11, which is on the opposite side of the wall in which the ink supply passage 8 is provided, constitutes the lid 2 of the container 11. This lid 2 is provided with an air vent 7.

The container 11 is substantially rectangular as shown in FIG. 1 or 2, and comprises an ink supply passage and the like. On the other hand, the fibrous member 4 to be filled within the container 11 does not have a rigid form. In other words, the fiber strands constituting the fibrous member 4 are not arranged to follow a certain rule, for example, to be bundled in a certain way. Instead, they are randomly arranged. This random arrangement is not only advantageous in terms of the ink retaining performance and ink delivery performance, which will be described later, but also make it easier for the fiber strands to conform to the contour of the internal space of the container 11. Therefore, the fibrous member 4 can be easily placed within the ink cartridge 1, without leaving any gap. After the fibrous member 4 is placed within the ink cartridge 1, the lid 2 constituting a part of the container is attached using ultrasonic welding, whereby a preferable degree of density can be given to the fibrous member 4.

Referring to FIG. 2, the ink cartridge 1 is connected to an inik jet head 12 with the use of an ink supply tube 14. In other words, the supply tube 14 is inserted into the supply passage 8 of the cartridge 1. This connection occurs on the cartridge (unillustrated) of an ink apparatus.

The following experiment was carried out using the ink cartridge described above.

Black ink was injected into the ink cartridge 1, and the ink cartridge 1 was rotated in every direction without plugging the openings. No ink leaked out of the ink supply passage 8 and air vent 7, which were the open portions of the ink cartridge 1. This proved that when the ink was retained by the fiber, the capillary force of the like could be generated to retain the ink.

In addition, a piece if silicon tube was inserted through the ink supply passage 8, and the ink was continuously sucked at a flow rate of 2 g/min will it became impossible to suck out any more ink. Then, the amount of the ink remaining within the ink cartridge, that is, the amount of the ink which could not be sucked out, was measure. It was 7.7 g. For the purpose of comparison, the same sucking test was carried out using an ink cartridge, in which, in place of the fibrous member 4, a piece of urethane foam (well-known material) having a volume of 160 cc and 35 cells per inch (cell was had been treated using the explosion method) had been compressed in the cartridge as the negative pressure generating member of this embodiment. The remaining amount of the ink was substantially the same. Those tests proved that the ink could be supplied in response to the ink consumption which occurred as the recording was made, and the ink flow was not interrupted within the ink passage in the early stage of the ink consumption.

It is understandable from the experiments described above that the ink cartridge comprising the fibrous member 4 of this embodiment displays such ink retaining performance and ink supplying performance that are equal to those of the conventional ink cartridge comprising the urethane foam piece.

An ink cartridge, in which strands or fiber are flexibly arranged to intersect with each other as they are in the ink cartridge in accordance with the present invention, functions at least equally to the conventional ones as described above. Such ink cartridge enjoys the following two specific advantages whether it comprises this structure or not.

The first advantage is related to the shelf life of the ink container when used with the ink that contains pigment, or the ink with high pH. In other words, when the polypropylene fiber of the first embodiment of the present invention is used as the negative pressure generating member, the amount of the ink solute, which deposits while an ink cartridge filled with the pigment ink is stored for a long period of time, is extremely small, and also, the deterioration of the negative pressure generating member is extremely small, in comparison to when the urethane foam is used as the conventional negative pressure generating member. Therefore, the cartridge comprising the polypropylene fiber strand as the negative pressure generating member can withstand practical usage.

As for another example of the first advantage, it can be pointed that the deterioration of the polypropylene is extremely small when used with the ink with a high pH, for example, no less than pH 10, or the ink with a low pH, for example, no more than pH 3.

When the inventors of the present invention measured the diameter of the ink particle, which serves as an index for the aforementioned deposition, at 60° C., involving a case in which the ink cartridge was filled with only the ink, a case in which it is filled with the ink and urethane foam, and a case in which it is filled with the ink and polypropylene fiber. The results are as follows.

| Period | 2 weeks | 2 months |
|---|---|---|
| ink only | 0.093 (μm) | 0.093 (pm) |
| urethane foam | 0.112 | 0.359 |
| polypropylene fibers | 0.093 | 0.118 |

As is evident from the results of the measurement described above, the polypropylene fiber is compatible with the pigment ink, and therefore, is preferable;e as the negative pressure generating member of the ink cartridge for storing the pigment ink.

As for the second advantage of the structure in accordance with the present invention, polypropylene, which is in the form of fiber, is a material suitable for recycling. In particular, when the container portion of the cartridge is also made of the same material as the fibrous portion as it is in the aforementioned embodiment, recycling steps can simplified.

For example, fiber (100 μm in diameter) can be obtained from a used ink cartridge comprising integrally the fiber and container by a melt-spinning machine after heating it to approximately 80° C. to evaporate the remaining ink components, through the color of the fiber obtainable through this recycling method is going to be black.

An ink cartridge was produced by filling the fibrous material thus obtained into the container in the same manner as described before, and was evaluated using the same method as described before. The amount of the remaining ink was 7.9 g, which was substantially the same as that obtained using the fiber made of virgin (pre-recycling) polypropylene. Therefore, it is easily understandable that the ink cartridge in accordance with the present invention is easily recyclable.

Further, resin chips produced by heating a used ink cartridge of the same type comprising the fiber and container portions to approximately 180° C. after evaporating the residual ink components can be formed into an ink cartridge container and lid using a molding apparatus.

The recycling process can be carried out using nothing but discarded ink cartridges as described above, but it is also possible to mix them, at an optional ratio, with resin which has not been used for forming fiber or the like.

As for the material to be used to form the ink cartridge in accordance with the present invention, any material usable for forming both the container and fiber portions is acceptable. As for the organic material, there are aramid, vinylon, acrylic, polyester, polyethylene, polypropylene, carbon. As for the nonorganic material, there are boron, glass (silica), alumina, and zirconia. As for the metallic material, there are tungsten molybdenum, steel, stainless steel, beryllium, titanium, aluminum, magnesium, and amorphous (Fe—Si—B group).

From the standpoint of ease of the initial molding, the organic or metallic material is preferable, wherein the organic material is more preferable in consideration of ease of handling. Further, from the standpoint of recycling, thermoplastic organic resins are further preferable since they can be easily recycled without going through such steps as cracking or refining.

As for further preferable thermoplastic resins, there are polyethylene, polyvinyl chloride, polystyrene, acrylonitrile, polypropylene, polyamide, polyacetal, polyethyleneterephthalate, polybutyleneterephthalate, polycarbonate, polyphenylene oxide, polyphenylene sulfide, polyether sulfon, polyether keton, polyether imide, polyamide imide, polysulfon, nylon, polyimide, and the like, as well as complex or denatured forms of these materials.

However, as stated before, when an emphasis is placed on the storage stability of the ink for an ink jet, olefinic resins such as polyethylene or polypropylene are particularly preferable.

Figure 3A:
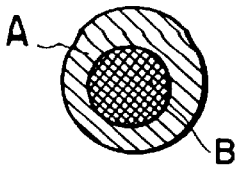
FIGS. 3(*a*) an 3(*b*) are structural sectional views of different types of fiber strands in accordance with the present invention.
Figure 3B:
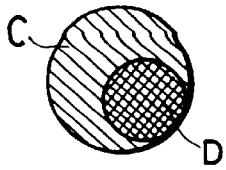

FIGS. 3(*a*) and 3(*b*) show approximate sections of the fibers composed of different material. It is optional to mix additives at a ratio that does not exceed the amount of the aforementioned resin.

In order for the fiber strands composed of the material selected from the list given above to function as the preferable negative pressure generating member suitable for the ink cartridge, it is preferable for the strands to intersect randomly with each other at multiple points within the ink cartridge as described previously. When the fiber strands are filled in the ink cartridge in an orderly manner like parallelly bundled fiber strands, the gaps among the fiber strands are reduced. As a result, the amount of the ink fillable within the ink cartridge is reduced. In other words, the amount of the usable ink relative to the internal volume of the container is reduced.

Figure 4:
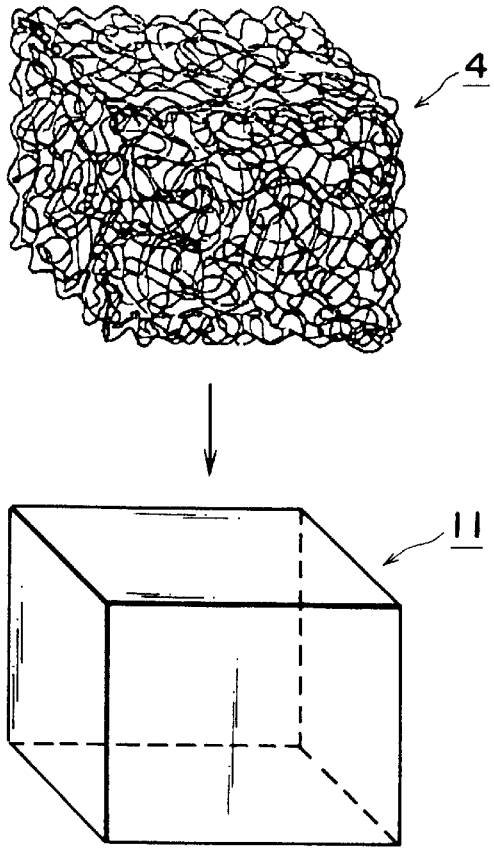
FIG. 4 is an explanatory view that describes the dimensional relation between the volume of the fibrous member in accordance with the present invention and that of the ink cartridge or container.

FIG. 4 depicts the relationship between the container 11 before the former is filled into the latter.

As will be evident from this drawing, as the fibrous member 4 is filled into the container 11, it is slightly compressed since the volume of the container 11 is slightly smaller than that of the fibrous member 4. As a result, a force proportional to the degree of compression is generated within the fibrous member 4 due to the elasticity of the fibrous member 4.

The following points should be noted here. In order for the above described first and second advantages to be effectively displayed, it is preferable that after the negative pressure generating member is filled into the cartridge, the volume of the fibrous member 4 is not reduced by the physical external force generated due to the vibration of the ink cartridge of the impact applied thereupon. More specifically, when the diameter of the first strand is extremely small, the overall volume of the fibrous member is reduced as the ink permeates between the fiber strands and causes the fiber strands within the fibrous member lump together, the volume of the fibrous member is sometimes reduced to a point where it falls to fill up satisfactorily the internal space of the ink cartridge, or shifts within the cartridge, preventing the ink from being swiftly supplied. It is guessed that this lumping is caused by the following reasons: as the ink makes contact with the fiber strands, the adjacent fiber strands are pulled closer to each other due to the surface tension of the ink permeating between them, whereby the gaps between them are reduced to decrease the overall volume of the fibrous member. As a result, the fibrous member, the volume of which has reduced below the internal volume of the ink cartridge, shifts within the ink cartridge. sometimes breaking the contact between the ink supply passage and filter, which results in a situation in which the ink cannot be supplied swiftly as described above.

As will be evident from the above description, it is preferable that the structure of the ink cartridge is such that the volume of the fibrous member within the ink cartridge does not decrease after the fiber strands come in contact with the ink.

Figure 13:
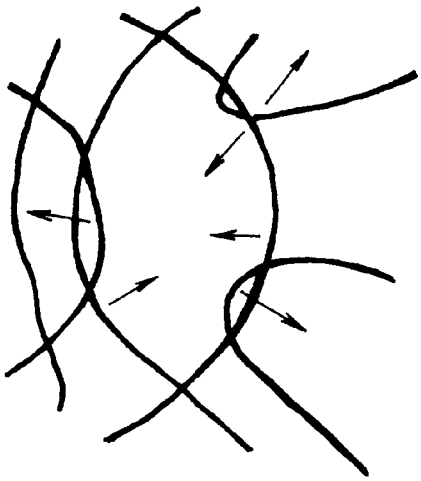
FIG. 13 is an explanatory drawing that depicts the functions of a plurality of complexly intersecting fiber strands in accordance with present invention.

In order to create such a structure, it is preferable for the fiber strands of the fibrous member 4 to intersect each other at multiple points as shown in FIG. 13. This is because the forces, which are generated by the surface tension of the ink or the like and work to move the fiber strands in the directions of arrow marks in the drawing when the fibrous member 4 comes in contact with the ink, cancel each other due to the presence of the multiple intersections, whereby the fibrous member is prevented from contacting.

In addition to the structure described above, there is another preferable structure, in which fibrous material having rigidity strong enough to resist the surface tension of the ink to be used is employed, or the fiber strand diameter is increased so that the fiber strands become rigid enough to resist the surface tension of the ink to be used. Further, it is preferable to select the fiber material depending on the ink to be used. It is also preferable to determine the amount of the fiber filled into the cartridge depending on the ink to be used.

As to means for causing the fiber strands to intersect at multiple points as described above, there is a method in which the fiber strands are bundled, and this bundle of fiber strands is teased several times in the direction parallel to the direction of the strands using an apparatus having comb-like teeth.

There is also a method in which the bundled fiber strands are cut to an optional length, and then, are stirred up using a stirring device.

As for another means, there is a method in which a negative pressure generating member having an apparent volume larger than the internal volume of the cartridge container is placed in the cartridge container, and then, is compressed by the cartridge lid or the like with a sufficient pressure.

As one of the preferable means, there is a method in which the negative pressure generating member is constituted of a certain type of fiber strand, the surface layer of which is composed of resin having a relatively low melting point as shown in FIG. 3, and the points of intersection are welded by heating the fibrous member at a temperature higher than the melting point of the external resin layer of the fiber strand and lower than the melting point of the core portion of the fiber strand to stabilize the positional arrangement of the fiber strand portions intersecting each other at multiple points.

Because of the reasons described above, and since the amount of the fiber to be filled in the cartridge varies depending on the internal volume and configuration of the ink cartridge, the structure of the negative pressure generating member, and the like factor, it is impossible to specify simply the diameter of the fiber strand for the negative pressure generating member to be used in the embodiments of the present invention, and also, to specify simply the amount of the fiber strands to be filled in the cartridge. However, in consideration of the fact that the generation of the negative pressure is dependent on the gap between the adjacent fiber strands, it is evident that when the gap is excessively large, the negative pressure is reduced to allow the ink to leak out of the ink cartridge, and contrarily, when it is excessively small, the negative pressure is increased too high to allow the ink to be supplied from the ink cartridge to the ink jet head. Thus, the fiber strand diameter is preferred to be in a range of 5 μm–1 mm; more preferably, 10 μm–0.5 mm; and most preferably, 15 μm–45 μm, though such preference depends on the internal volume of the ink cartridge and/or the amount of the fiber strands to be filled in the ink cartridge.

As for the preferable diameter range of the fiber strands intersecting each other at multiple points, relative to the location at which each fiber strand is disposed, it is preferred to be within a range of 20–40 μm if the fiber strand is disposed near the ink supply port, and to be no less than 40 μm if it is disposed in other areas. The more preferable diameter range for the strand disposed in the other areas is 50–100 μm.

There is no particular restriction concerning the filling of the fiber strands into the ink cartridge, but it is preferable to press the fiber strands at least in one direction by the lid or the like, as described before, in order to prevent the fiber strands from shifting within the ink cartridge. Further, in consideration of the fact that when a gap, which is larger than the gap between the adjacent fiber strands, is created where the fibrous member 4 contacts the filter 8A of the ink supply passage, it is possible for the ink supply from the ink cartridge to the ink jet head to be interrupted; therefore, it is more preferable that the fiber strands are pressed toward the filter of the ink supply passage.

Figure 5:
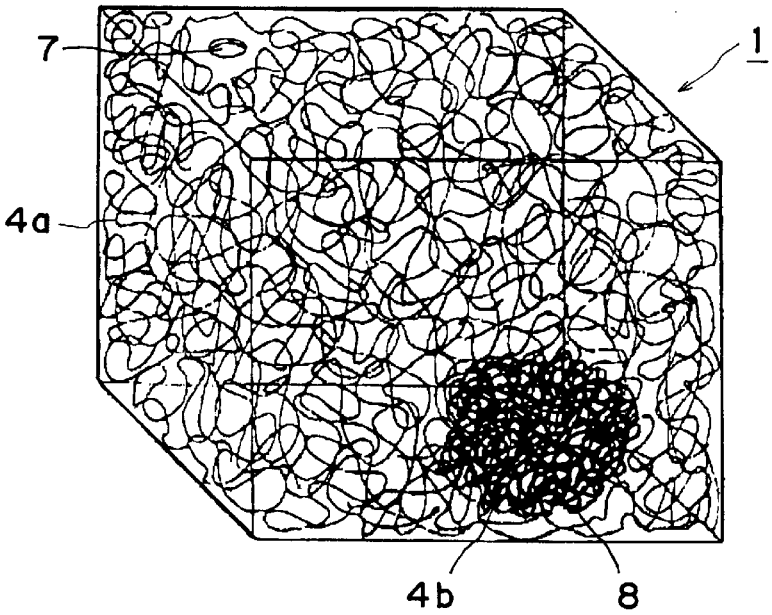
FIG. 5 is a schematic perspective view of another embodiment of ink container in accordance with the present invention.
Figure 6:
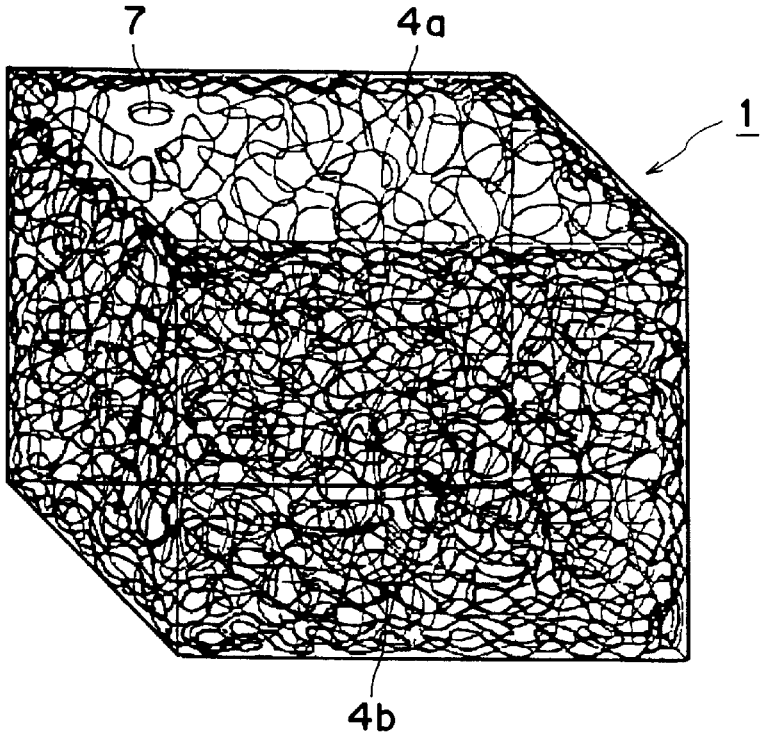
FIG. 6 is a schematic perspective view of another embodiment of ink container in accordance with the present invention.

FIGS. 5 and 6 are schematic views of other embodiments of ink cartridge in accordance with the present invention.

Referring to FIG. 5, the density is varied so as to increase toward the ink supply passage 8 by means of disposing fiber strands with a smaller diameter 4*b* adjacent to the surface of the filter 8A of the ink supply passage 8, and fiber strands with a relatively larger diameter 4*a* in the other areas, in a compressing manner. With this arrangement, the ink within the ink cartridge is likely to concentrate toward the ink supply passage 8, being less likely to be left unused.

FIG. 6 is a schematic view of one of the embodiments of ink cartridge in accordance with the present invention, in which the smaller diameter fiber strand 4*b* is disposed along the internal surface of the container portion 11 of the cartridge, in such a manner as to form a sort of an envelop, and the larger diameter fiber strand 4*a* is disposed in such a manner as to be enclosed within the envelop.

In this cartridge, the fiber strand 4*b* disposed along the internal wall surface serves to generate the negative pressure of the ink cartridge, whereas the fiber strand 4*a* disposed within the pouch of the fiber strand 4*b* generates a relatively low negative pressure to increase the ink usage efficiency. In other words, the negative pressure generated by the fiber strand 4*a* is lower than that of the fiber strand 4*b*; therefore, the fiber strand 4*a* displays less ink retaining capability, and a smaller amount of the ink will remain unused therein. As is evident from this description, the functions can be easily separated in this cartridge.

It should be noted here that the technology for providing the negative pressure generating member with the density gradient as described above has been known with regard to the conventional ink container comprising the urethane foam or the like. In the case of the urethane foam, the density distribution within the negative pressure generating member is controlled using the following two means: (1) before the foam material is inserted into the cartridge, its configuration is changed (including the method of cutting notches in the foam material), so that the compression ratio varies within the foam material after the insertion, and (2) projections or the like are provided within the ink cartridge to control the density distribution of the negative pressure generating member. In the case of (1), a foam material piece having an unusual (complicated) configuration is to be inserted into the ink cartridge, which is liable to cause the inserted foam material piece to wrinkle, wherein the wrinkle occurring at an unexpected location sometimes deteriorates the performance of the ink cartridge.

Further, the foam material piece must be processed to be formed into the unusual (complicated) configuration, which sometimes increases the manufacturing cost. In the case of (2), the foam material may be in a simple form, for example, rectangular, but since it is quite common that the projections are provided within the ink cartridge, the internal volume of the ink cartridge is reduced; in other words, the ink capacity of the cartridge is decreased, resulting in the reduction of ink usage efficiency.

On the contrary, in the case of the negative pressure generating member used in the present invention, it is possible to give the negative pressure generating member the density gradient as described above by means of simply mixing the fiber strands having a different diameter and/or a shape. Therefore, in the case of the present invention, disposing mixedly within the ink cartridge a number of fiber strands with a different diameter as the negative pressure generating member creates a preferable structure for improving the performance of the ink cartridge.

Here, the technical concept of using fibrous material as the negative pressure generating member, which runs through the preceding embodiments, can be summarized as follows.

Firstly, the fiber strand constituting the fibrous member is regulated to a predetermined length, whereby the fibrous member filled into the ink container is deformed within an elastically deformable range, so that the fiber strands therein intersect each other at multiple points.

Figure 7:
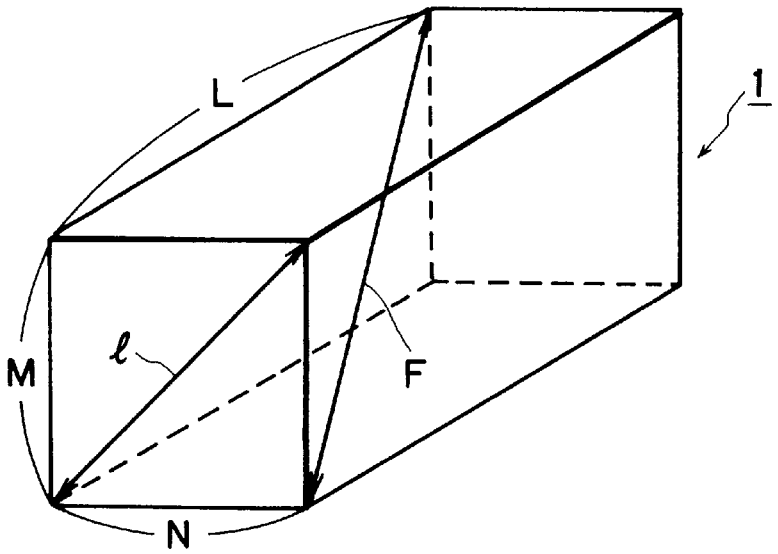
FIG. 7 is a perspective view of the ink container in accordance with the present invention, and shows the relationship between the measurements of the ink container and the length of the fiber strand.

For example, referring to FIG. 7, let it be assumed that the length, width, and height of the substantially rectangular ink cartridge 1 are L, N and M, and the diagonal line of the surface containing M and N is 1. The preferable range for the length of the fiber strand constituting the fibrous member is to be no less than 1. The more preferable range is to be no less than the length of the diagonal line F of the rectangular parallelepiped. When such a requirement is satisfied, each of the fiber strands filled in the cartridge 1 is deformed within the elastically deformable range to intersect with others at multiple points.

Secondary, fibrous material pieces, each of which is constituted of fiber strands having a different diameter from those of the other fibrous material pieces, are disposed at predetermined points within the ink cartridge 1.

For example, referring to FIG. 8, the fibrous material piece 4*b* constituted of the fiber strands with a relatively small diameter is disposed adjacent to the filter 8A of the ink supply passage 8 so as to make contact therewith, and the fibrous material piece 4*a* constituted of the fiber strands with a diameter larger than that of the strands constituting the fibrous material piece 4*b* is filled so as to surround the fibrous material piece 4*b* and fill the rest of the internal space of the ink cartridge. With this arrangement, the flow resistance of the filter, which conventionally constituted the major portion of the flow resistance through the ink supply passage from the ink container to the ink jet head, is reduced, whereby the ink supply performance is enhanced, and at the same time, the deterioration of the ink retaining capability of the ink container can be prevented.

To describe more specifically, the following table is given.

TABLE 1

| Filter line (resistance) | Container | |
|---|---|---|
| CONV. 12–15 μm | Sponge line approx. 90 μm | |
| EMB. 20 μm | Fibers 4b Dia. 25–40 μm | Fibers 4a Dia. 50–100 μm |

In comparison with the conventional arrangement the filter diameter is increased to reduce its flow resistance, which constitutes the major portion of the flow resistance when the ink is supplied. With this arrangement, the overall ink delivery resistance is reduced. Also, the fibrous material composed of the fiber strands with a smaller diameter is disposed adjacent to the filter; therefore, it is possible to concentrate the ink toward the ink supply passage, and at the same time, prevent the ink from leaking from the filter or ink supply passage.

FIG. 9 depicts another embodiment of the present invention, to which the second technical concept is applied when a different type of negative pressure generating member is employed.

In FIG. 9, an alphanumeric reference 40*a* designates a piece of felt composed of fiber strands with a relatively large diameter, and 40*b* designates a piece of felt composed of fiber strands with a diameter smaller than that of the felt 40*a*. This embodiment does not give the fiber strands as much freedom as the embodiments described before, but since the relative diameter of the fiber strand is reduced toward the supply port side, it enjoys such advantages that the flowability of the ink within the ink container is improved; and that the internal space fillable with the ink is increased relative to the space filled with the fibrous material, while reducing the amount of the unusable amount of the ink within the ink container. Further, since the felt 40*b* composed of the finer fiber strands is placed in contact with the fiber 8A, the diameter of the filter 8A can be rendered larger in this embodiment than in the cartridge with the conventional structure.

In the descriptions of the preceding embodiments, nothing has been mentioned about the ribs to be provided within the ink cartridge for introducing the atmospheric air or for the like purposes. Such ribs may be provided, and when provided, it is essential that there is a proper amount of contact at least between the filter of the ink supply passage and the fibrous material.

FIGS. 10(*a*)–10(*h*) are sectional views depicting the sections of various fiber strands that constitute the fibrous member 4 in the different embodiments of the present invention.

The sectional configuration of the fiber strand may be in any of the configurations depicted in these drawings. In particular, however, in order to increase the volume of the void within the cartridge filled with the fibrous material, the fiber strands having a sectional configuration with ridges and valleys as shown in FIGS. 10(*f*)–10(*h*), and those having a hollow structure as shown in FIGS. 10(*e*) and 10(*g*), are more preferable. Further, in the cases of the fiber strands having one of the sectional configurations depicted in FIGS. 10(*e*)–10(*h*), even when they become parallelly bundled, the volume of the void that functions in a predetermined manner as the negative pressure generating member is not reduced, which makes them preferable.

Figure 11A:
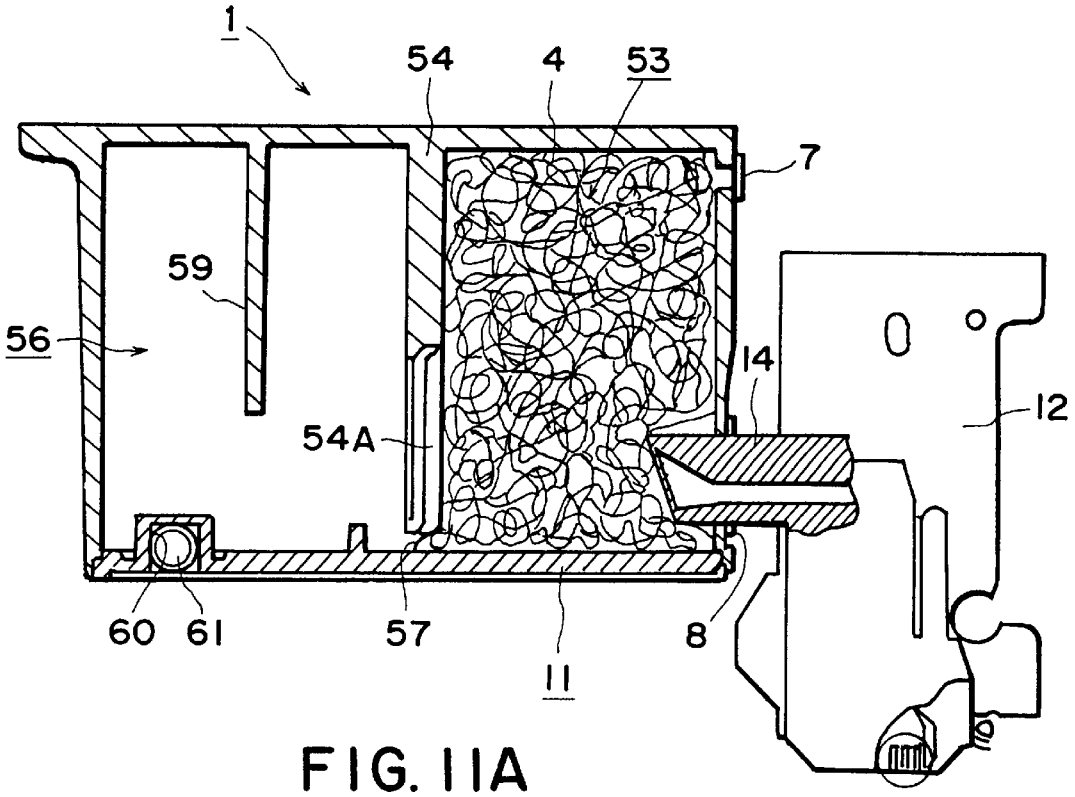
FIGS. 11A and 11B are sectional views of another ink cartridge employing the fiber strand in accordance with the present invention as the negative pressure generating member.

FIG. 11A is a sectional view of another example of ink cartridge, in which the fibrous member embodied in accordance with the present invention is employed as the negative pressure generating member.

Figure 11B:
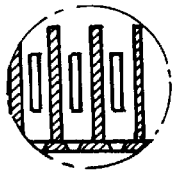

The ink cartridge 1 of this embodiment illustrated in FIG. 9 comprises an ink supply passage 8 where it is connected to an ink jet recording head 12, whose discharge ports are shown in insert FIG. 11B a negative pressure generating member accommodating portion 53 for accommodating the fibrous member 4 as the negative pressure generating member, and an ink storing portion 56 which is disposed next to the negative pressure generating member accommodating portion 53 with the interposition of a rib 54, and is connected thereto through a connecting portion 57 provided at the bottom portion 55 of the ink cartridge.

In FIG. 11A, a reference numeral 7 designates an air vent for allowing the interior of the negative pressure generating member accommodating portion 53 to be in communication with the atmosphere; 59, a rib for improving the strength of the ink storing portion 56; 60, an opening through which the ink is filled into the ink container cartridge; and a reference numeral 61 designates a sealing member for sealing the opening 60. The rib 54 is provided with a groove 54A for carrying out the gas-liquid exchange between the ink within the ink storing portion and the atmospheric air to be introduced into the negative pressure generating member accommodating portion through the air vent 58. With the presence of this structure, the ink within the negative pressure generating member accommodating portion is first consumed, and then, the ink within the ink storing portion 56 is consumed after the ink level within this portion 53 drops to the groove 54A, and the aforementioned gas-liquid exchange begins to allow the ink in the ink storing portion 56 to be supplied to the portion 53 side through the connecting portion 57.

Figure 12:
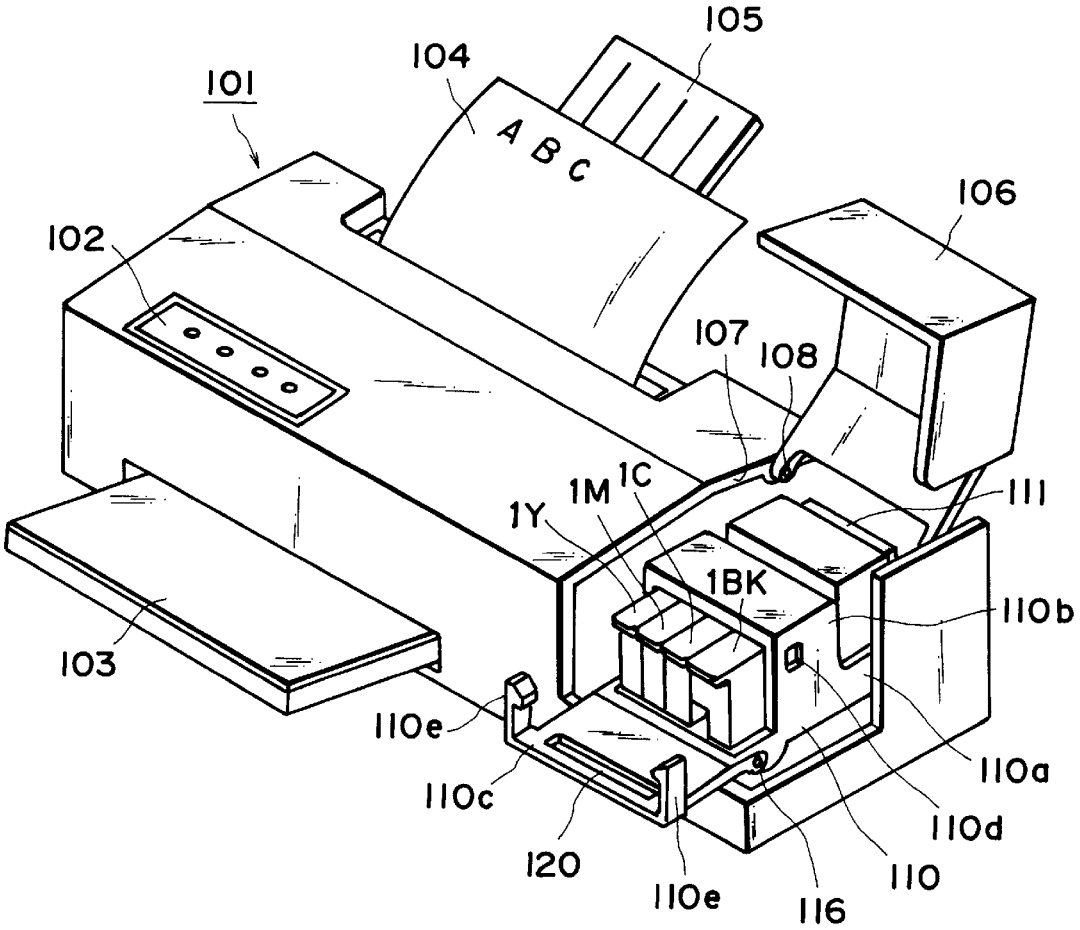
FIG. 12 is a perspective view of a typical ink jet recording apparatus employing the ink cartridge illustrated in FIG. 11.

FIG. 12 is a perspective view of an ink jet recording apparatus as a printer usable with the ink cartridge illustrated in FIG. 10.

In FIG. 12, a reference numeral 101 designates a printer; 102, a control panel provided in the frontal portion of the top surface of the housing of the printer 101; 103, a sheet feeder cassette to be installed through the frontal opening of the aforementioned housing; 104, a sheet of paper (recording medium) fed out of the sheet feeder cassette 103; and a reference numeral 105 designates a tray for holding the sheets of paper discharged through the sheet conveying passage within the aforementioned printer 101. The member designated by a reference numeral 106 is a main assembly cover having an L-shaped sectional configuration. This main assembly cover 106 covers an opening 107 provided in the right front portion of the housing, and is rotatively attached to the inward facing surfaces of the opening 107 using hinges 108. Within the housing, a carriage 110 supported with guides or the like (unillustrated) is disposed. The carriage 110 is reciprocative in the direction of the width of the sheet passed through the sheet conveying path, that is, in the direction parallel to the longitudinal direction of the aforementioned guides or the like.

The carriage 110 of this embodiment generally comprises a stage 110*a* supplied horizontally with the guides or the like, an opening (unillustrated), which is formed in this stage 110*a* adjacent to the guides and in which the ink jet head is mounted, a cartridge garage 110*b* for accommodating the ink cartridges 1Y, 1M, 1C and 1Bk mounted on the stage 110*a* located in front of this opening, and a cartridge holder 110*c* for preventing the cartridges mounted in this garage 110*b* from dropping out.

The aforementioned stage 110*a* is slidably supported, at the rear portion, with the aforementioned guides, and its front end portion is resting on an unillustrated guide plate. This guide plate may double as a sheet pressing member for preventing the sheet conveyed through the aforementioned sheet conveying path from lifting up, or as a member capable of functioning to lift the stage from the guides in response to the thickness of the sheet, in the manner of a cantilever.

As for the opening of the stage 110*a*, an ink jet head (unillustrated) is mounted thereon, with its ink ejecting orifices facing downward.

The cartridge garage 110*b* is provided with a through hole extending in the front-rear direction for accommodating four ink cartridges 1Y, 1M, 1C and 1Bk all together, and also, with an engagement notch, which is located in each of the outward facing lateral surfaces and is engaged with the engagement claw of the cartridge holder 110*c*.

At the front end portion of the stage 110*a*, the cartridge holder 110c is rotatively attached with the hinge 116. The distance from the front surface of the garage 110*b* to the hinge 116 is determined in consideration of the distance the cartridges 1Y, 1M, 1C and 1Bk project from the front end of the garage 110*b* when they are placed within the garage 110*b*, and the like measurement. The cartridge holder 110*c* is in the form of a substantially rectangular plate. The cartridge holder 110*c* is provided with a pair of engaging claws 110*e*, which project from the correspondent corners located away from the corners fixed with the aforementioned hinge 116, in the direction perpendicular to the surface of the plate portion of the cartridge holder 110*c*. The plate portion of the cartridge holder 11*c* is provided with an accommodating hole 120 which accomodates the tab portion of cartridges 1Y, 1M, 1C, and 1Bk. This accomodating hole 120 has a size and a shape that match the tabs, and is positioned to correspond with the tab positions.

As is evident from the descriptions given above, according to the present invention, when the fibrous material is employed as the negative pressure generating member in the ink cartridge, the narrowing of the gap between the adjacent fiber strands can be prevented while the ink is filled into the cartridge may result in the insufficient ink delivery, ink leak, and the like, which occur as the reduced distance between the adjacent fiber strands deteriorates the ink retaining capability of the cartridge, but the narrowing can be prevented.

Also, an ink container suitable for the change of the specific ink properties due to the fiber strand diameter, can be provided.

It is also possible to provide an ink container, in which the diameter of the fiber strand within the container is preferably regulated, and the flow resistance of the filter itself that creates the dynamic resistance to the ink movement can be eased.

Next, a manufacturing method for the ink container will be described.

Figure 14:
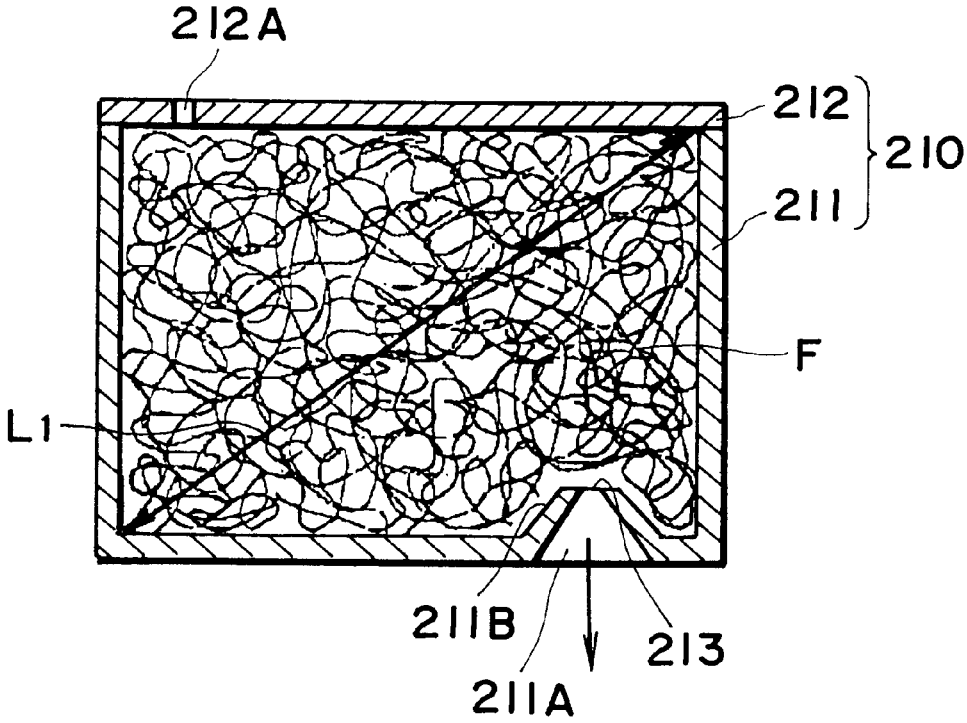
FIG. 14 is a sectional view of an ink container manufactured according to the first embodiment of ink container manufacturing method in accordance with the present invention.

First, the first embodiment of the ink container manufacturing method in accordance with the present invention will be described with reference to FIGS. 14 and 15. FIG. 14 is a sectional view of a finished ink container, and FIG. 15 describes the manufacturing steps for the ink container.

In FIG. 14, the main body 210 of the ink container is formed by joining a container 211 and a lid 212. The ink and a fibrous member F capable of retaining the ink are contained in the container main body 210. The container main body 210 is provided with an ink supply port 211A and an air vent 212A. From the ink supply port 211A, a cone-shaped projection 211B projects into the container main body 210, and the inward tip of the cone-shaped projection 211B is provided with a filter 213. The ink container of this embodiment is usable as an ink cartridge to be replaceable mounted on, for example, the recording head of an ink jet recording apparatus.

Figures 15A, 15B, 15C, 15D:
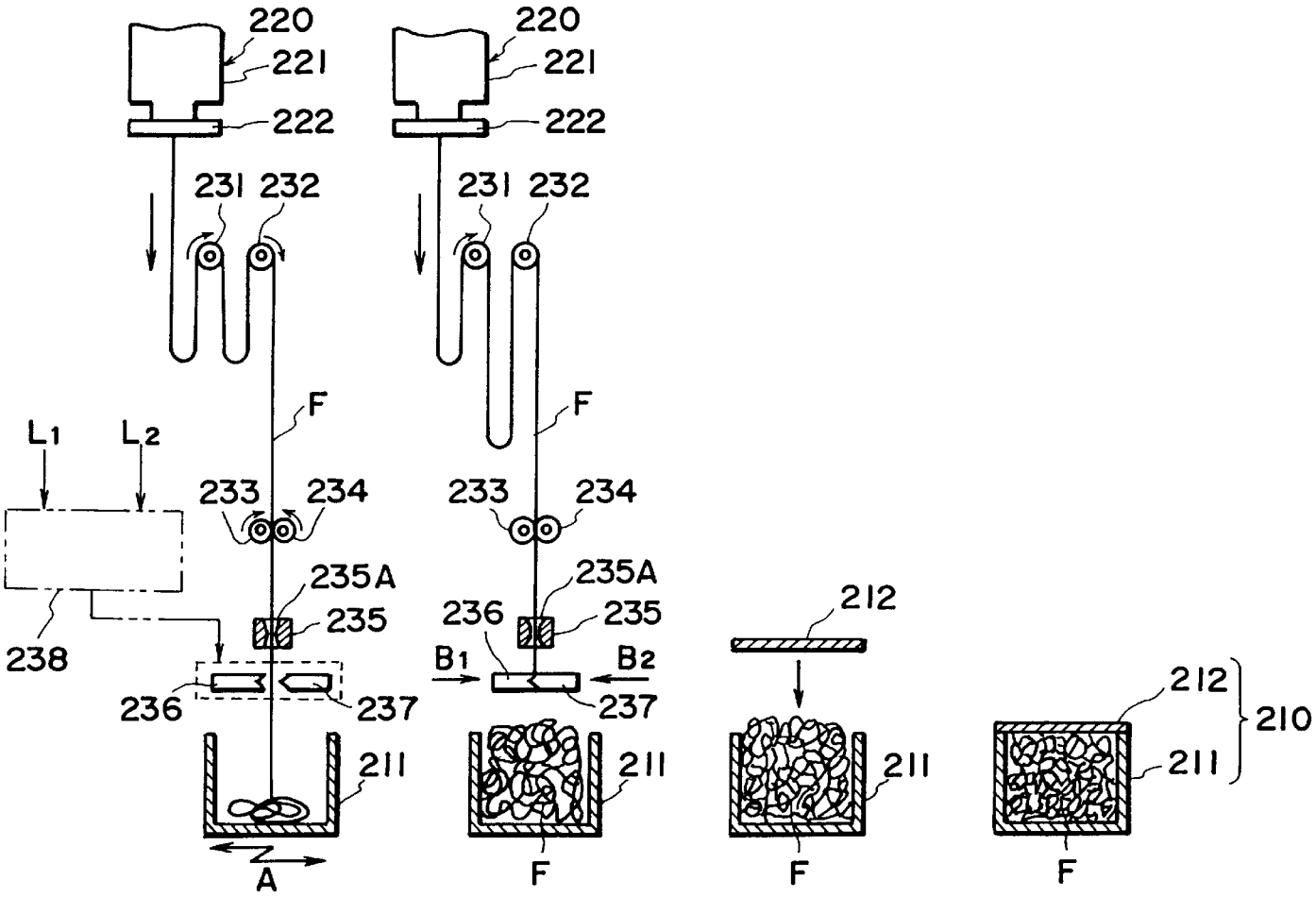
FIGS. 15(A–D) are schematic drawings that describes the ink container manufacturing steps of the first embodiment of the ink container manufacturing method in accordance with the present invention.

Such an ink container is manufactured through the steps illustrated in FIGS. 15(*a*), 15(*b*), 15(*c*) and 15(*d*).

To begin with, a long continuous strand of fiber F produced continuously with a fiber producing apparatus 220 is placed into the container 211 as shown in FIG. 15(*a*).

The fiber producing apparatus 20 produces a continuous strand of, for example, polyolefinic polypropylene fiber, wherein the continuous strands of polypropylene fiber F is produced by means of extruding the melted fiber material within a furnace 221 from a spinning nozzle 222.

The continuous fiber strand F extruded from this fiber producing apparatus is temporarily rested between rollers 231 and 232, and then, is sent out into the guide hole 35A of a feeding guide 35 by a pair of feeding rollers 233 and 234, so as to be introduced into the container 211. While the fiber strand F is introduced into the container 211, the container 211 is reciprocated in the horizontal direction (direction of an arrow mark A), and the feeding guide 35 is reciprocated in the direction perpendicular to the surface of FIG. 15, so that the fiber strand F is accumulated substantially evenly in the container 211. It should be noted here that a number of continuous fiber strands F produced simultaneously by the fiber producing apparatus 220 may be introduced into a single container 211, and also, that a number of such fiber strands may be introduced after being twisted together.

After the fiber strand F is accumulated in the container 211 by a predetermined length, the feeding rollers 233 and 234 are stopped, and a pair of blades 236 and 237 are moved in the directions of arrow marks B1 and B2, respectively, to cut the fiber strand F by pinching it between them (FIG. 15(*b*)). Meanwhile, the fiber strand F being extruded from the fiber producing apparatus 220 is rested between the rollers 231 and 232. The amount of the rested fiber strand F can be adjusted by means of controlling the rotation of the rollers 231 and 232.

Next, the lid 212 is closed, as illustrated in FIG. 15(*c*), onto the container 211 in which the fiber strand F has been accumulated, and then, the container 211 and lid 212 are joined, as shown in FIG. 15(*d*), to form the container main body 210, using ultrasonic waves or the like. It should be noted here the the accumulated fiber strand F bulging above the container 211 is preferred to be pressed down into the container 211 with a pressing member, compressed air, or the like.

When both the container 211 and lid 212 are formed of thermally fusible resin, they can be easily joined by thermal welding. Further, when the container 211 and 212 are formed of the same thermally fusible resin (for example, polypropylene) as the fiber strand F, the joint can be properly sealed even if the fiber strand F is pinched between the joining surfaces, since the joining surfaces are thermally welded together with the pinched fiber strand. in addition, after the ink container is used, in other words, after the ink in the ink container is completely consumed, there is no need for separating the fiber strand F as the ink retaining member from the container main body 210, and they can be processed together (for example, melted together at a temperature higher than the boiling point of the stored ink) to be recycled.

The ink may be stored in the container 211 either before or after joining the container 211 and lid 212, wherein the ink is absorbed into and retained between the gaps created between the adjacent portions of the fiber strand F due to the capillary force generated there. For example, the ink may be stored into the container main body 210 through the ink supply port 211A (FIG. 14) or an unillustrated ink injecting port after the container main body 210 is completed by joining the container 211 and lid 212. It is also acceptable to store the ink into the container 211 during the operation for guiding the fiber strand F into the container 211, before the beginning of the operation, or immediately after the end of the operation. It should be noted here that when the ink is stored before joining the container 211 and lid 212, the ink supply port is kept sealed as needed.

When the fiber strand F is placed into the container 211 after the ink is stored, it must be taken into consideration that the solvent of the ink might evaporate due to the heat possessed by the fiber strand F; therefore, it is preferable to increase in advance the amount of the solvent in the ink by the amount estimated to evaporate while the ink is stored into the container 211. For example, when it is estimated that 20% of the solvent of the ink is evaporated by the heat of the fiber strand F, all that is necessary is to reduce the ink density by means of increasing in advance the amount of the ink solvent by the correspondent amount. it is also acceptable to store the ink in the following manner: the ink solvent is stored in advance in the container 211; next, the fiber strand F is placed; and finally, the ink solute is stored with or without the solvent so as for the resultant ink to have the optimum density. In this case, not only the fiber strand F is cooled by the ink solvent stored in advance in the container 211, being stabilized within the solvent in terms of positional arrangement, but also, the surface of the fiber strand F becomes more wettable, or more compatible, with the ink.

The ink container completed through the steps of placing the fiber strand F and the ink in the container main body 210 as described above is used as the ink cartridge, which is mounted in, for example, an ink jet recording apparatus, with its ink supply port 211A (FIG. 14) being connected to the recording head.

During usage, that is, during the recording operation in which ink is ejected from the ink ejecting orifices of the recording head, the ink retained by the fiber strand F is supplied to the recording head through the ink supply port 211A; within the container main body 210, the ink is delivered to the ink supply port 211A by the apparent negative pressure generated by the fiber strand F. When the recording operation is not going on, the ink is prevented from leaking by the ink retaining capability of the fiber strand F.

Since the fiber strand F is a continuous long strand, the amount of waste particles or chips, which are liable to be generated at the cut surface of the fiber strand F. can be minimized; therefore, the filter 213 (FIG. 14) is prevented from being clogged with such refuse. In other words, the clogging of the filter 213, which his liable to occur when the fiber strands F having been cut relatively short are employed, can be avoided.

As for the material suitable for forming both the container main body 210 and fiber strand F, it is preferable to use the organic or metallic material, in consideration of ease of the initial formation thereof (before recycling), wherein from the standpoint of handling, the organic material is more preferable. When recyclability is taken into consideration, the thermoplastic resins, which can be easily recycled without going through the processing steps such as cracking or refining, are far more preferable. Further, when an emphasis is placed on the stability of the material (compatibility with the ink for ink jet recording during an extended storage period), olefinic resins such as polyethylene or polypropylene are particularly preferable.

It has been already stated that in order for the fiber strand F composed of a material selected from among the aforementioned choices of material to function properly as a preferable ink retaining member during ink jet recording, the fiber strand F is preferred to intersect randomly with itself at multiple points within the container main body 210. Contrarily, when the fiber strand F is placed in the container main body 210 in an orderly manner like being parallelly bundled, the void within the container main body 210 is reduce; in other words, the space fillable with the ink is reduced. As a result, the ink capacity of the container main body 210 relative to the internal volume thereof is reduced.

As for the sectional configuration of the fiber strand F, any configuration is acceptable. However, in order to increase the volume of the void within the cartridge filled with the fiber strand F, the fiber strand F with the sectional configuration having the ridges and valleys at the periphery, or the hollow one, is preferable.

It is not possible to specify generally the diameter and amount of the fiber strand F to be filled in the container main body 210 since they vary depending on the internal volume and configuration of the container main body 210. However, in consideration of the fact that the generation of the negative pressure is dependent on the gap between the adjacent portions of the fiber strand F, it is evident that when the gap is excessively large, the negative pressure is reduced, allowing the ink to leak out of the container main body 210, and contrarily, when it is excessively small, the negative pressure is increased too high to allow the ink to be supplied from the container main body 210 to the recording head. Thus the diameter of the fiber strand F is preferred to be in a range of 5 $\mu$m–1 mm, more preferably, 10 $\mu$m–0.5 mm though such preference depends on the internal volume of the container main body 210 and/or the amount of the fiber strand F to be filled thereinto.

In order to prevent the fiber strand F from shifting within the container main body 210, it is preferable to press the fiber strand F at least in one direction by the lid 2 or the like. Further, when a large gap is generated between the adjacent portions of the fiber strand F, at the location where the fiber strand F contacts the ink supply port 211A, it is possible for the ink supply from the container main body 210 to the recording head to be interrupted; therefore, it is more preferable that the fiber strand F is pressed toward the ink supply port 211A.

Further, the fiber strand F may be cut to a predetermined length with the blades 236 and 237 while the fiber strand F is introduced into the container 211 as shown in FIG. 15(*a*). In this case, the only control a controlling means 238 of the blades 236 and 237 has to execute is to operate the blades 236 and 237 each time the fiber strand F is delivered by a predetermined distance by the feeding rollers 233 and 234. It is preferable that the length by which the fiber strand F is cut is larger than the length of the diagonal line L1 of the container main body 210 (FIG. 14). With such an arrangement, the cut fiber strand F is bent in the container main body 210, whereby the cut fiber strands F are caused to intersect with each other in a tangly manner so as to provide sufficient ink retaining capability. More specifically, the fiber strand F is cut to a length of 10 cm. Further, when it is intended to give the fiber strand density a gradient within the container main body 210 as will be described later, the length by which the fiber strand is cut may be changed corresponding to where the cut fiber strand is disposed within the container main body 210. When the continuous fiber strand F is placed within the container 211 without being cut, all that is necessary is to input the wanted length L2 (for example, 1 m) of a single continuous fiber strand F in the controlling means 238.

Figures 16A, 16B, 16C, 16D, 16E, 16F:
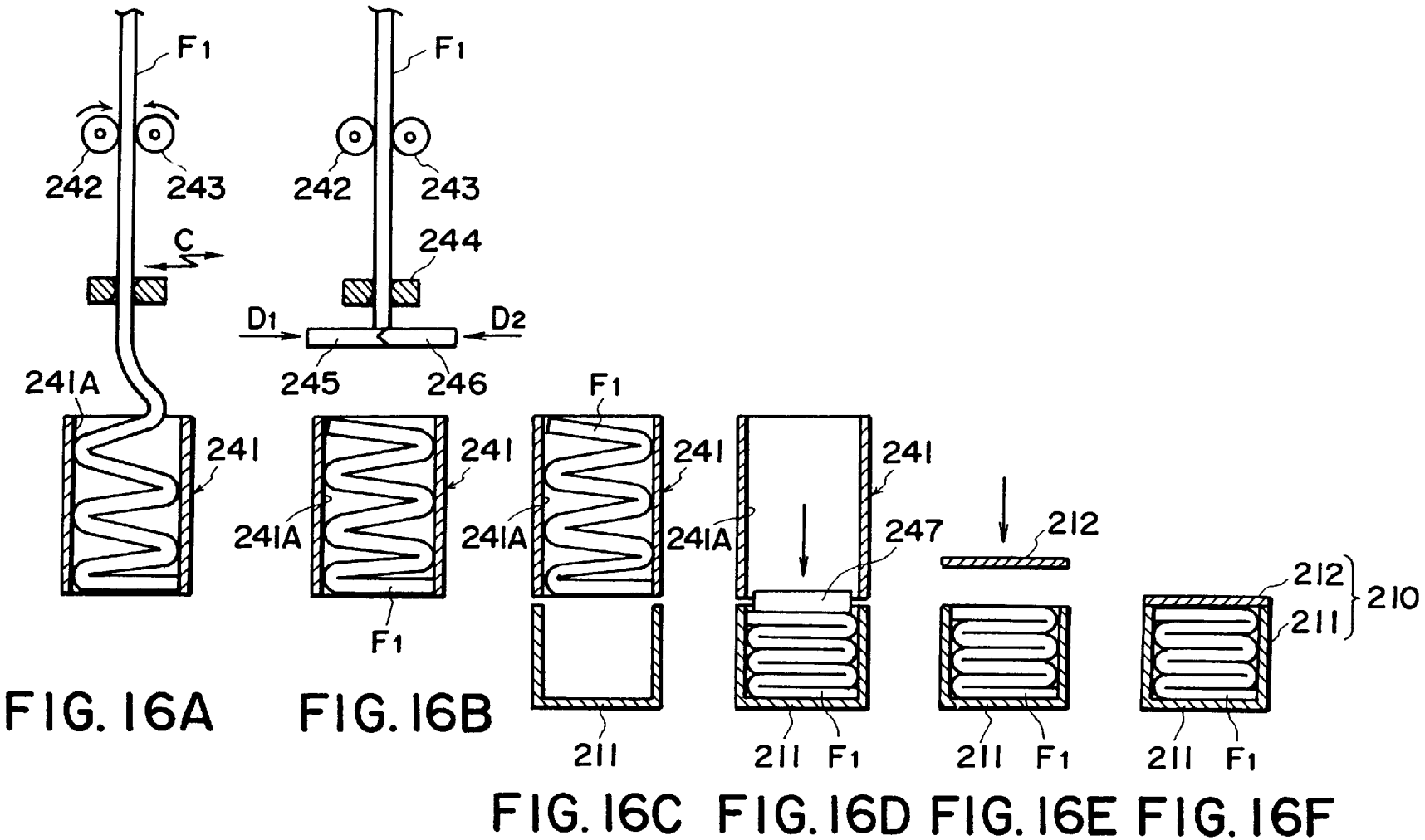
FIGS. 16(A–F) are schematic drawings that describes an ink container manufacturing steps of the second embodiment of ink container manufacturing method in accordance with the present invention.

FIG. 16 is an explanatory drawing for describing the second embodiment of the manufacturing steps for the ink container in accordance with the present invention. The container main body 210 in this drawing comprises a container 211 and a lid 212 as the one in the aforementioned embodiment illustrated in FIG. 14 does.

In this embodiment, the fiber strand F is formed into a long belt of fibrous aggregate F1, and then, the fibrous aggregate belt F1 is folded into the container 211. For example, when thermally fusible polyolefinic resin such as polypropylene is used as the material for the fiber strand F, the fiber strand F is first aggregated, and then, the surface portion of thus formed fibrous aggregate is heated to weld the complex intersections of the fiber strand F, so that the fiber strand F is formed into a stable belt of fibrous aggregate F1. As for the form of the fiber strand aggregation within the aggregate F1, it may be such that one or several long strands of fiber randomly intersect at multiple points; that a large number of short fiber strands (several centimeters) randomly intersect at multiple points; that a large number of long fiber strands are bundled so as to extend in the longitudinal direction of the aggregate F1; or the like form. The sectional configuration of the belt of the aggregate F1 is optional; for example, it may be rectangular. In other words, it may be optionally selected depending on the configuration or the like of the container main body 210.

When such an aggregate F1 is placed in the container 211, it is first folded into a hollow guide member 241 as illustrated in FIG. 16(*a*). More specifically, while the aggregate F1 is fed downward of the drawing by a pair of feeding rollers 242 and 243, through the guiding hole 244*a* of a feeding guide 244, being guided into the guide member 241, the feeding guide 244 is reciprocated in the direction of an arrow mark C in the same drawing, so that the aggregate F1 is folded. It is desirable that at the moment of each folding, an external force is imparted on the fold-back portion of the aggregate F1 by an unillustrated auxiliary means, so that the aggregate F1 is reliably folded not the guide member 241. As for the auxiliary means, a pressing means or compressed air may be used to press the aggregate F1 in the folding direction or downward.

After the aggregate F1 long enough to fill up the container main body 210 is folded into the guide member 241, the rollers 242 and 243 are stopped as shown in FIG. 16(*c*), and at the same time, a pair of blades 245 and 246 are moved in the direction of arrow marks D1 and D2, respectively, to cut the aggregate F1 between the two blades. Within the guide member 241, a holding portion 241A is provided, which is structured as a portion of the guide member 241, that is, a portion where the internal diameter of the guide member 241 is slightly reduced, or as a projection disposed on the internal peripheral surface of the guide member 241, so as to help to compress the aggregate F1 and hold it. Instead, the holding portion 241A may be replaced with a cap closing the downward opening of the guide member 241. In any case, what counts is the capability to hold the aggregate F1 within the guide member 241.

Next, the guide member 241 and container 211 are put together in alignment as shown in FIG. 16(*c*), and then, the aggregate F1 within the guide member 241 is pushed down into the container 211, with a pressing member 247. Thereafter, the container 211 and lid 212 are joined as they were in the preceding embodiment (FIGS. 16(*e*) and 16(*f*)). The placement of the ink into the container main body may be either before or after joining the two components.

Figures 17A, 17B, 17C, 17D, 17E, 17F:
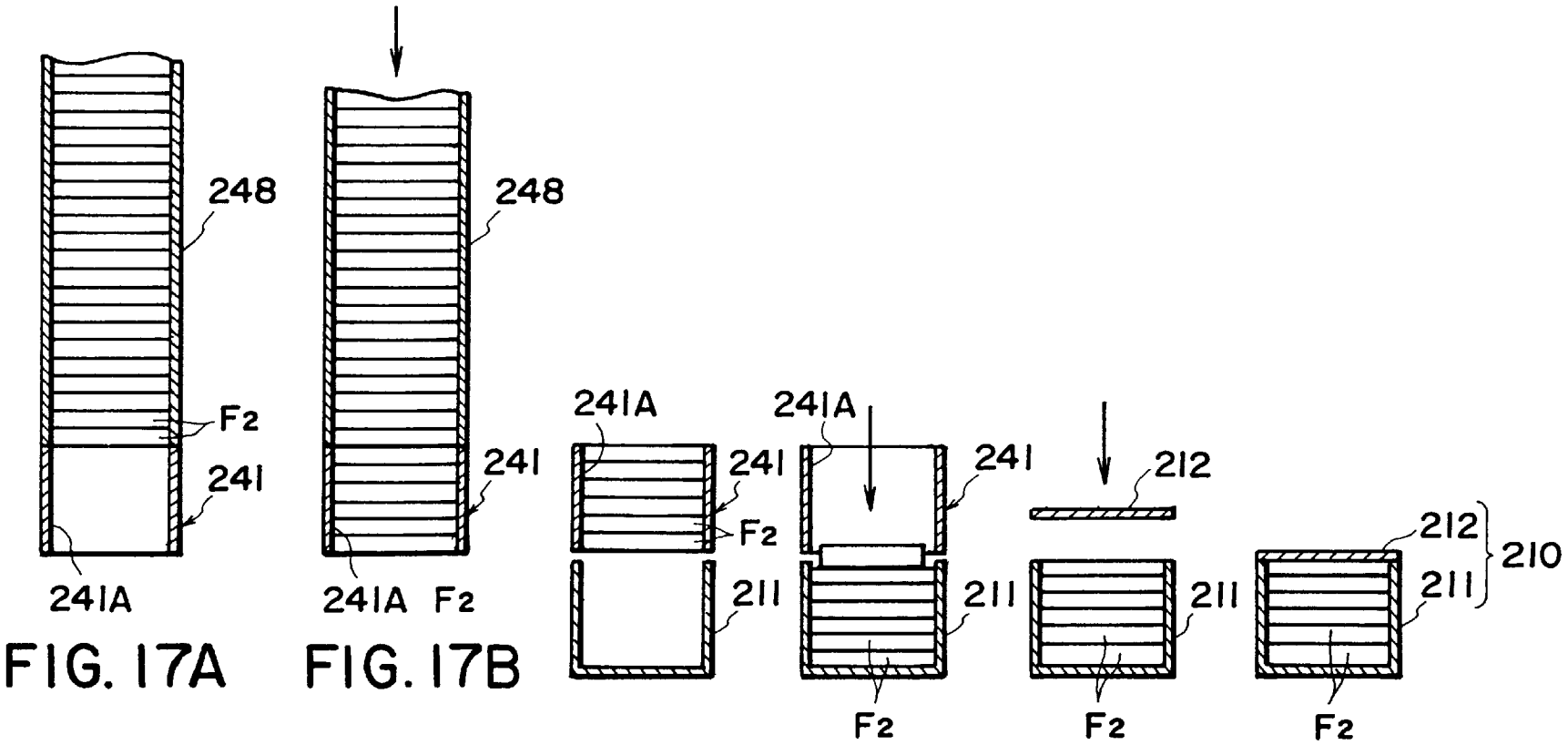
FIGS. 17(A–F) are a schematic drawings that describes an ink container manufacturing steps of the third embodiment of ink container manufacturing method in accordance with the present invention.

FIG. 17 is an explanatory drawing that describes the steps of the third embodiment of ink container manufacturing method in accordance with the present invention. This embodiment is different from the second embodiment in that the fiber strand F is formed into a plate-shaped fibrous aggregate F2. The configuration of the plate of the fibrous aggregate F2 is optional, and is selected to match the configuration of the container main body 210.

This aggregate F2 is stocked in the stocker 248 (FIG. 17(*a*)). When placed into the container 211, it is first pushed down into the guide member 241, being held there, as illustrated in FIG. 17(*b*), and then, is moved into the container 211 with a pressing member 247. Thereafter, the container 211 and lid 212 are joined together in the same manner as the preceding embodiments (FIGS. 17(*c*) and 17(*f*)). Also in this case, the placement of the ink may be either before or after joining the two components.

Figures 18A, 18B, 18C, 18D:
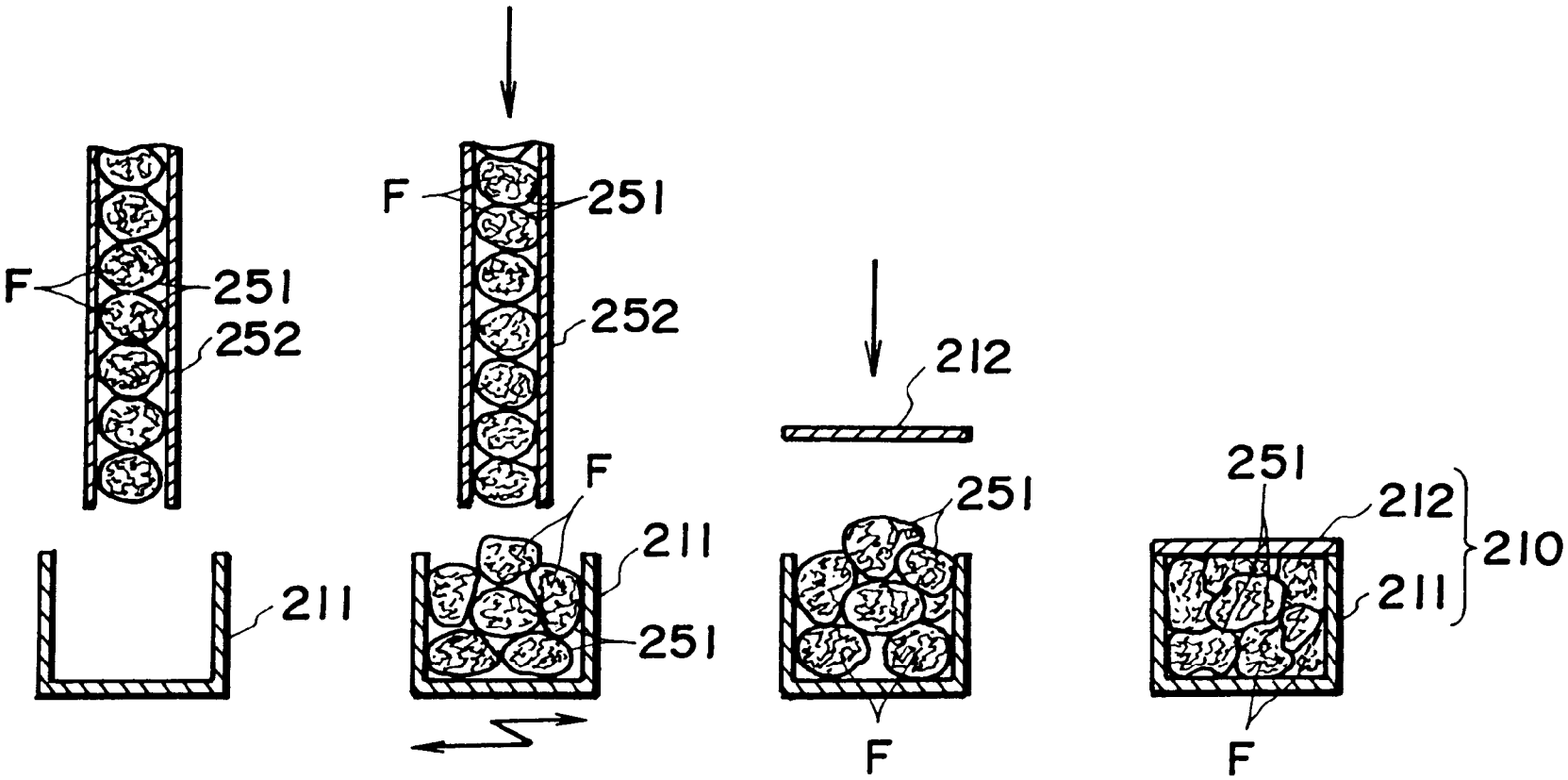
FIG. 18(A–D) are a schematic drawings that describes an ink container manufacturing steps of the fourth embodiment of ink container manufacturing method in accordance with the present invention.

FIG. 18 is an explanatory drawing that describes the steps of the fourth embodiment of the ink container manufacturing method in accordance with the present invention. In this embodiment, the fiber strand F is placed in a pouch 251 in advance, and then, the pouch 251 filled with the fiber strand F is placed in the container 211. The pouch 251, which is in the form of net or is provided with numerous pores, allows the ink to permeate through it. As for the material of the pouch 251, the same material as those for the fiber strand F and container main body 210 may be used. For example, when the pouch 251 is composed of thermally fusible resin, it can be sealed using the thermal welding. As for the arrangement of the fiber strand F in the pouch 251, it may be such that one or several long strands of fiber randomly intersect with each other at multiple points; that a large number of short strands of fiber (several centimeters long) intersect with each other at multiple points; a large number of long strands of fiber are bundled together; or the like arrangement.

The pouch 251 containing the fiber strand F is stocked in the stocker 252 in advance (FIG. 18(*a*)), and when it is necessary to be placed in the container 211, it is pushed down to be dropped into the container 211 (FIG. 18(*b*)). At this time, the container 211 is horizontally moved to shift sequentially the landing point of the pouch 251 in the container 211, so that the dropped pouches 251 are substantially evenly distributed in the container 211. Further, the container 211 may be vibrated in the horizontal and/or vertical direction to pack more tightly the pouches 251. It is also possible to vibrate and/or move the stocker 252 in order to drop evenly the pouches 251 into the container 211.

The number of the pouches 251 to be dropped into a single container 211 is determined in advance on the basis of the sizes of the container 211 and pouch 251, packing density of the fiber strand F in the pouch 251, or the like factor. After an appropriate number of the pouches 251 are dropped into the container 211, the container 211 and lid 212 are joined in the same manner as they were in the preceding embodiments (FIGS. 18(*c*) and 18(*d*)). The ink is placed in the container 211 either before or after joining the two components.

Figures 19A, 19B, 19C, 19D, 19E:
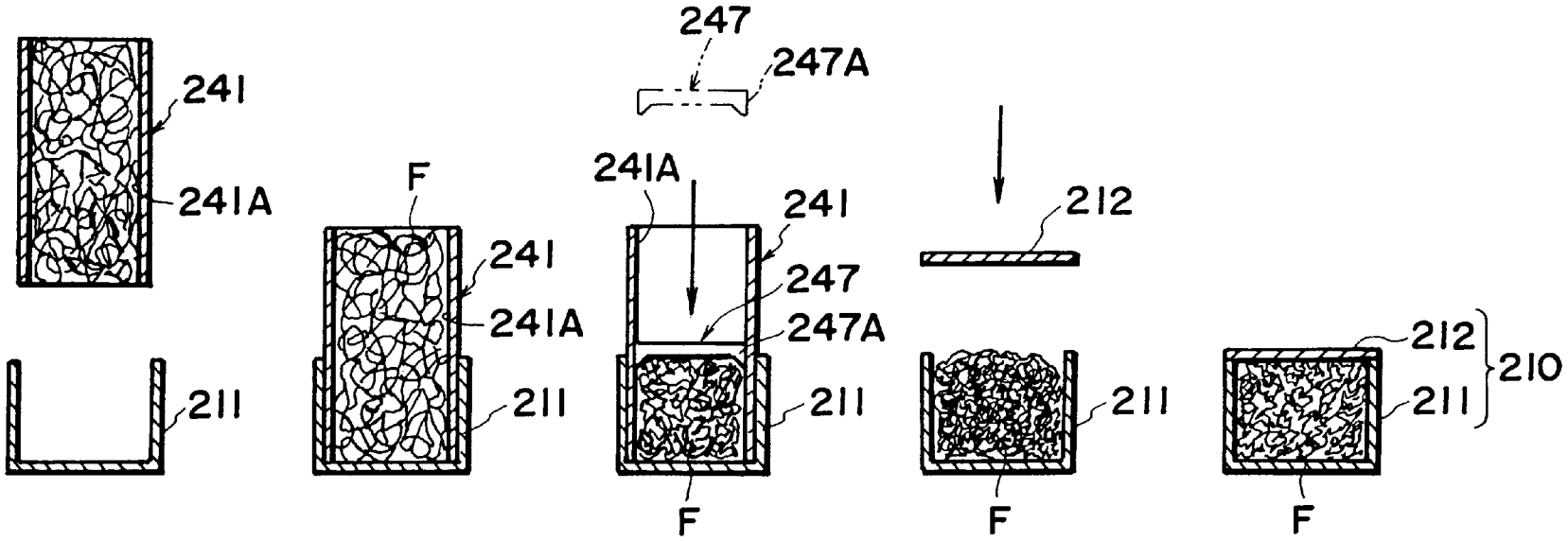
FIGS. 19(A–E) are a schematic drawings that describes an ink container manufacturing steps of the fifth embodiment of ink container manufacturing method in accordance with the present invention.

FIG. 19 is an explanatory drawing that describes the steps of the fifth embodiment of the ink container manufacturing method in accordance with the present invention. This embodiment is different from the aforementioned second embodiment in that the fiber strand F is placed in the container 211 without being first fixed in the guide member 241. Further, in this embodiment, the bottom portion of the guide member 241 is fitted into the container 211 (FIGS. 19(*a*) and 19(*b*)), and then, the fiber strand F is pushed downward into the container 211, with a pressing member 247, as shown in FIG. 19(*c*)). Around the bottom edge of the pressing member 247, a projection 247A is provided, which projects downward and pressed harder the portion of the fiber strand F facing the projection 247A, preventing thereby the fiber-strand F from being pinched between the joining surfaces of the container 211 and lid 212, as shown in FIG. 19(*d*). After the fiber strand F is moved into the container 211, the container 211 and lid 212 are joined as they were in the preceding embodiments. The ink may be placed either before or after joining the two components.

As for the arrangement of the fiber strand F in the guide member 241, that is, the arrangement in which the fiber strand F is subsequently placed in the container main body 210, it may be such that one or several long strands of fiber randomly intersect at multiple points; that a large number of short fiber strands (several centimeters long) randomly intersect at multiple points; that a large number of long fiber strands are bundled so as to extend in the longitudinal direction of the fibrous aggregate F1; or the like arrangement.

It is not mandatory that the guide member 241 is provided with the holding portion 241. For example, the fiber strand F may be guided down into the container 211 after the bottom portion of the guide member 241 is fitted into the container 211 as illustrated in FIG. 19(*b*). In this case, the internal space of the guide member 241 serves as the guiding path for the fiber strand F.

Figure 20A:
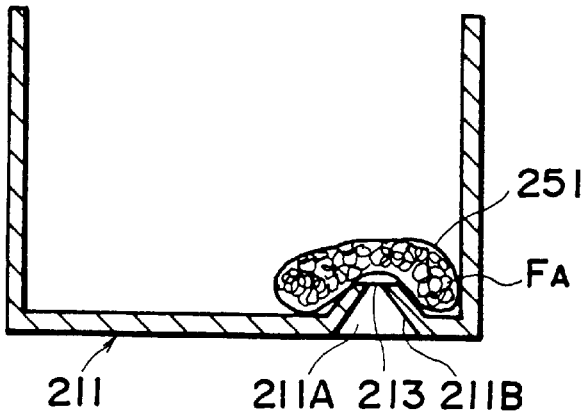
FIGS. 20(A–C) are a schematic drawings that describes an ink container manufacturing steps of the sixth embodiment of ink container manufacturing method in accordance with the present invention.
Figure 20B:
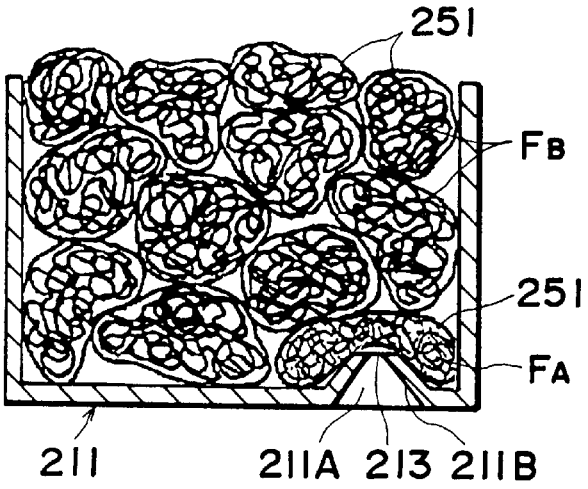
Figure 20C:
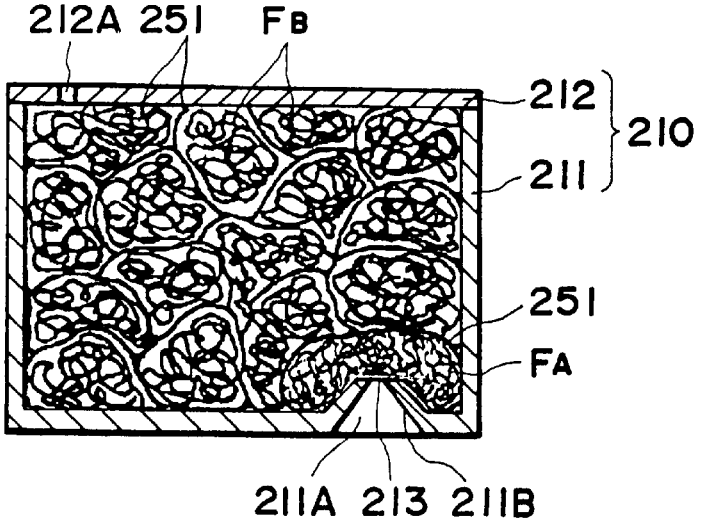

FIG. 20 is an explanatory drawing that describes the steps of the sixth embodiment of the ink container manufacturing method in accordance with the present invention. Also in this embodiment, the pouches 251 are used as they were in the fourth embodiment illustrated in FIG. 18, except that there are two types of pouches in this embodiment: those containing the fiber strand FA with a smaller diameter and those containing the fiber strand FB containing the fiber strand with a larger diameter. After the pouches 251 are dropped into the container 211, the lid 212 is joined with the container 211 as it was in the fourth embodiment, wherein the pouch 251 containing the smaller diameter fiber strand FA is disposed so as to face the ink supply port 211A. Such an arrangement is realized in the following manner; after a pouch 251 containing the smaller diameter fiber strand FA is disposed on the filter 213 as illustrated in FIG. 20(*a*), pouches 251 containing the larger diameter fiber strand FB are deposited (FIG. 20(*b*)), and then, the lid 212 is joined (FIG. 20(*c*)).

The ink retaining capability (generation of apparent negative pressure) of the fiber strand F, which is given by the capillary phenomenon, is proportional to the size of the gap between the adjacent portions of the fiber strand F; in the case of the smaller diameter fiber strand FA; the gap between the adjacent portions of the fiber strand F is small, which makes the ink retaining capability stronger, whereas, in the case of the larger diameter fiber strand FB, the gap is larger, which makes the ink retaining capability weaker. Such ink retaining capability varies depending on not only the external diameter of the fiber strand, but also, the sectional configuration thereof; therefore, the combination of the fiber strands FA and FB may be replaced with a combination of fiber strands different in the sectional configuration.

When the fiber density in the container main body 210 is increased toward the ink supply port 211A, it is easier for the ink within the container main body 210 to collect toward the ink supply port 211A, which reduces the amount of the ink left unused. Further, the projection 211B projecting inward from the ink supply port 211 functions to compress the fiber strand FA, increasing further the density thereof.

What is important in this case is for the pouch 251 filled with the smaller diameter fiber strand FA to be disposed to face the ink supply port 211A. When it is placed in the container 211 at the same time as the other pouches, or when the structure of the container 211 is such that when the pouch 251 is placed in the container 211, the ink supply port 211A comes to be situated at the top, it may be placed after the other pouches 251 are deposited. Further, it is also acceptable to prepare three or more types of pouches, each containing a fiber strand F of a different diameter, which are placed in the container 210, sequentially or at the same time, in such a manner as to increase the fiber strand density toward the ink supply port 211A in the container main body.

Figure 21A:
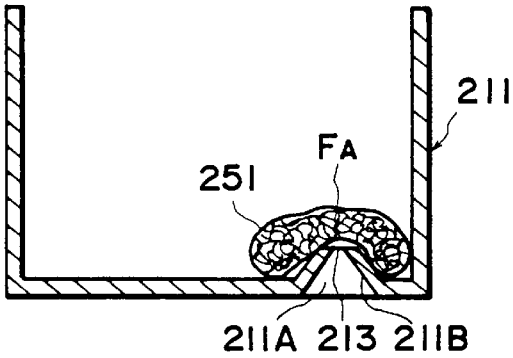
FIGS. 21(A–C) are a schematic drawings that describes an ink container manufacturing steps of the seventh embodiment of ink container manufacturing method in accordance with the present invention.
Figure 21B:
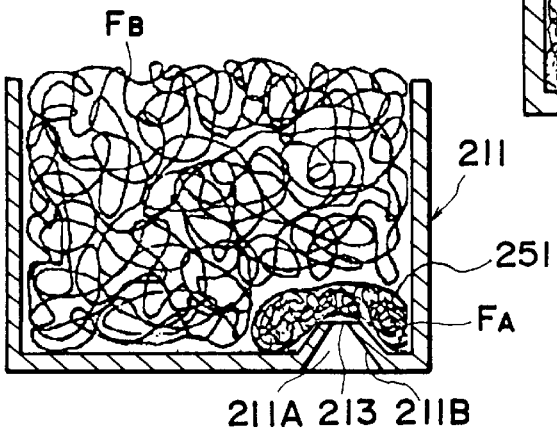
Figure 21C:
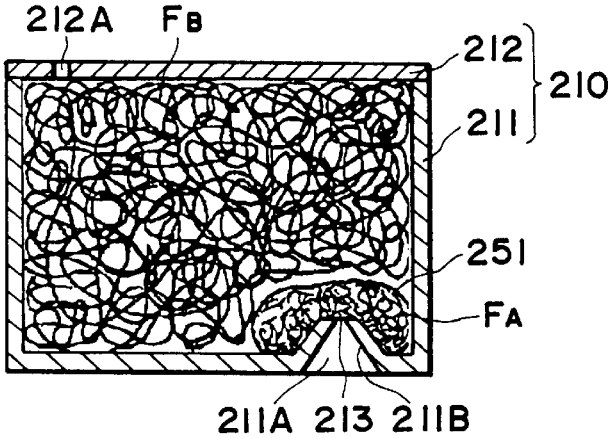

FIG. 21 is an explanatory drawing that describes the steps of the seventh embodiment of the ink container manufacturing method in accordance with the present invention. In this embodiment, a fiber strand FB, which is equivalent to the fiber strand FB in the sixth embodiment described above, is placed in the container 211 without being packed in the pouch 251. As for the placing method of the fiber strand FB, the one employed in the first or fifth embodiment may be employed. Further, two or more different types of fiber strands may be placed, as the fiber strand FB, in the container 211, so that the fiber density is increased toward the ink supply port 211A. Also, the fiber strand FB may be placed in the container 211 without being packed in the pouch 251, using the same method as the aforementioned first or fifth embodiment; in this case, it may be placed in such a manner that the fiber strands FA and FB are aggregated into the form matching the internal configuration of the container 211, and the fibrous aggregate thus formed is placed in the container 211, wherein the aggregate can be stabilized by means of welding the fiber portions at multiple points at which the fiber portions exposed at the surface intersect with each other.

Figure 22:
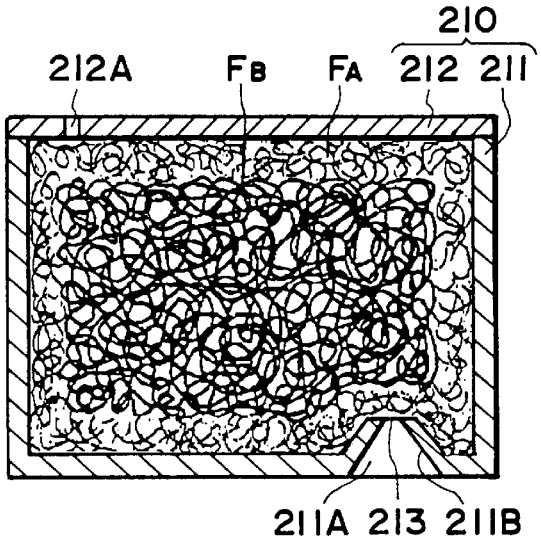
FIG. 22 is a schematic drawing that describes an ink container manufacturing steps of the eighth embodiment of ink container manufacturing method in accordance with the present invention.

FIG. 22 is a sectional view of an ink container that describes the eighth embodiment of the ink container manufacturing method in accordance with the present invention. In this embodiment, the fibrous aggregate is formed in such a manner that the aggregate of the larger diameter fiber strand is enclosed within the aggregate of the smaller diameter fiber strand FB, and then, the fibrous aggregate thus formed is placed in the container 211. This fibrous aggregate can be also stabilized by means of welding the fiber strand portions exposed at the surface of the aggregate at multiple points at which the fiber strand portions intersect each other. As for the placing method for the aggregate, the method employed in the fifth embodiment (FIG. 19), for example, may be employed. In the ink container of this embodiment, the apparent negative pressure is primarily generated by the smaller diameter fiber strand FA disposed along the internal wall surface of the container main body 210, whereas the larger diameter fiber strand FB positioned within the smaller diameter fiber strand FA generates a smaller amount of the apparent negative pressure, which results in weaker ink retaining capability, but reduces the ratio of the ink left unused.

Figure 23:
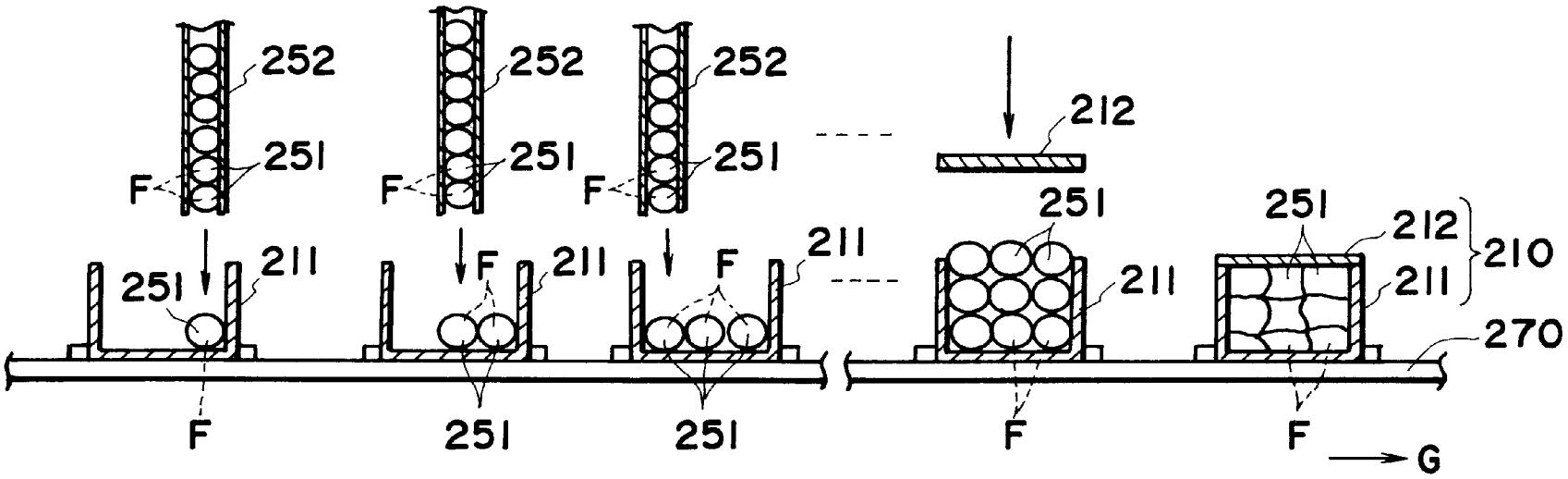
FIG. 23 is schematic drawing that describes an ink container manufacturing steps of the ninth embodiment of ink container manufacturing method in accordance with the present invention.

FIG. 23 is an explanatory drawing that describes the steps of the ninth embodiment of the ink container manufacturing method in accordance with the present invention. In this embodiment, the pouches 251, in which the fiber strand F is packed in the same manner as the fourth embodiment illustrated in FIG. 18, are deposited in the container 211 while the container 211 is continuously or intermittently moved in the direction of an arrow mark G by a conveyer belt 270. Then, the lid 212 is joined with the container 211. Therefore, a number of stockers 252 are arranged in the direction of the path of the container 211, wherein the pouch 251 is dropped form each of the stockers 252 into the container 211, to be disposed at a predetermined location within the container 211.

Figure 24:
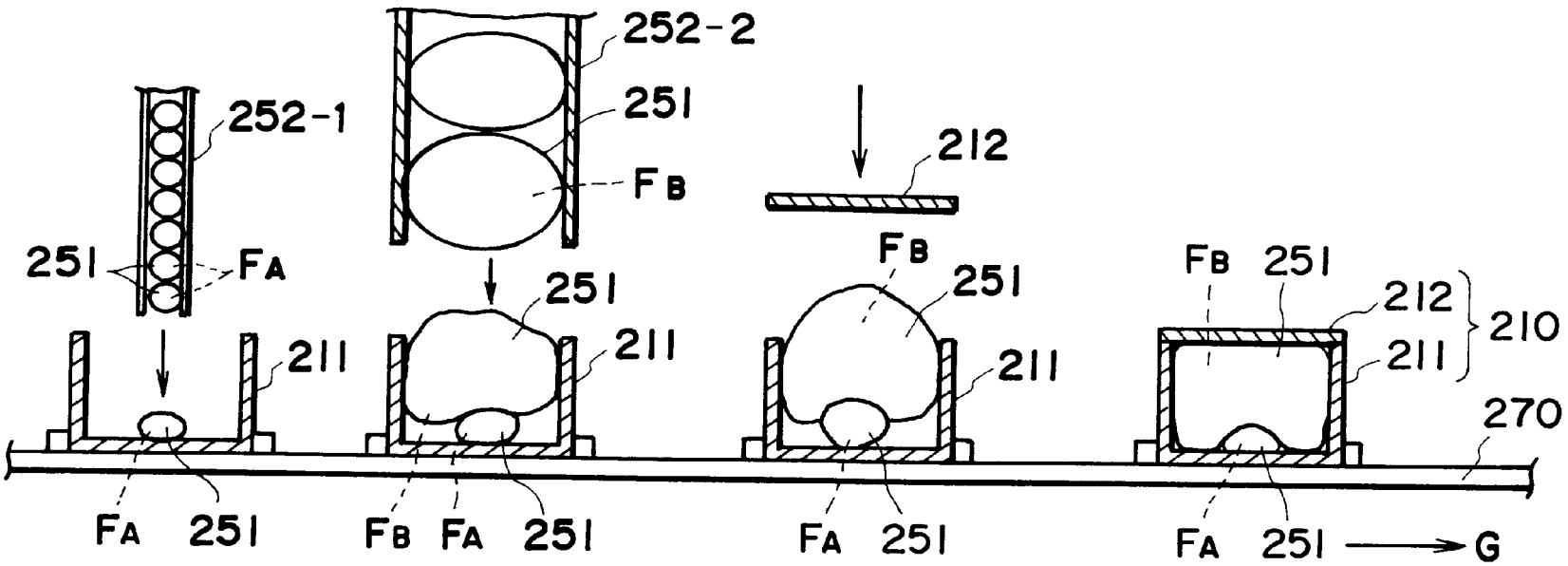
FIG. 24 is schematic drawing that describes an ink container manufacturing steps of the tenth embodiment of ink container manufacturing method in accordance with the present invention.

FIG. 24 is an explanatory drawing that describes the steps of the tenth embodiment of the ink container manufacturing method in accordance with the present invention. In this embodiment, a pouch 251 containing the smaller diameter fiber strand FA and a pouch 251 container the larger diameter fiber strand FB are dropped into the container 211 placed on a conveyer belt 270, from stockers 252-1 and 252-2, respectively, in the same manner as the sixth embodiment illustrated in FIG. 20, and then, the lid 212 is joined with the container 211. The pouch 251 containing the smaller diameter fiber strand FA is dropped into the container 211 so as to face an unillustrated ink supply port.

As described above, in the case of the ink container manufacturing method in accordance with the present invention, the fiber strand is led into the container main body as it is continuously produced; therefore, the fiber strand and ink container can be manufactured through a continuous operation, which makes it possible to eliminate the storage facility for the fiber strands, or the like.

Further, in this ink container manufacturing method, the continuous fiber strand is led into the container main body after being temporarily rested; therefore, the ink container can be manufactured without interrupting the continuous production of the fiber strand.

Further, when the ink container is manufactured through such a procedure that the fiber strand is formed into a belt of fibrous aggregate, and then, this belt of fibrous aggregate is folded into the container main body, the fiber strand is prevented from scattering; therefore, it can be reliably placed in the container.

In addition, when the ink container is manufacture through such a procedure that the aggregate of fiber strand is produced in advance, and then, a predetermined number of these aggregate pieces are placed in the container main body, not only can the fiber strand be reliably placed in the container main body while preventing it from being scattered, but also, the number of the aggregate pieces to be placed in the container main body can be changed, depending on the type of the ink container; therefore, this method is applicable to various ink containers.

When the ink container is manufactured through another procedure in which the fiber strand is packed in a pouch, and then, this pouch containing the fiber strand is placed in the container main body, the fiber strand can be reliably placed in the container while preventing the scattering of the fiber strand.

When the ink container is manufactured through such a procedure that the fiber strand is led into the container main body through the guiding path of the guide member, the fiber strand can be smoothly and reliably placed in the container while preventing it from being scattered.

When the ink container is manufactured through another procedure in which the fiber strand is placed in the container main body after the fiber strand is once held in the guide member to regulate the aggregating form of the fiber strand, the fiber strand can be reliably and smoothly placed in the container.

When the polyolefinic material is used as the material for the fiber strand, it is possible to give the ink container compatibility with various types of ink, for example, alkaline ink, and also, to stabilize the structure of the fiber strand aggregate using the thermally fusible properties of the material.

Further, when two or more types of fiber strands different in external diameter or sectional configuration are employed as the fiber strands to be placed in the container main body, the ink retaining capability of the fiber strand can be established to be optimal for their position within the ink container main body.

When the ink container is manufactured through such a procedure that the ink is placed in the container main body before the fiber strand is placed therein, a certain degree of flexibility is afforded in the ink container manufacturing process, wherein the ink can be prevented from being denatured, by means of increasing the amount of the solvent in the ink by the amount equivalent to the amount of the solvent that evaporates when the fiber strand is placed in the container.

Further, when the fiber strand is placed in the container after the ink solvent is placed in the container main body, it is possible to improve, in the ink solvent, the arrangement in which the fiber strand is placed in the container, and also, to improve the wettability of the fiber strand surface to the ink.

While the invention has been described with reference to the structures disclosed herein, it is not confined to the details set forth and this application is intended to cover such modifications or changes as may come within the purposes of the improvements or the scope of the following claims.

What is claimed is:

1. An ink jet apparatus comprising:

an ink container having an ink discharging portion and containing a fibrous ink containing member; and an ink jet head for receiving ink from said ink discharge portion, wherein said fibrous ink containing member includes fibers having diameters which are smaller adjacent said ink discharging portion than other portions of said fibrous ink containing member.

2. An ink jet apparatus according to claim 1, further comprising:

a filter provided between said discharging portion and said ink jet head, wherein said filter has mesh sizes which are smaller adjacent said ink discharging portion than other portions of said filter.

3. An ink jet apparatus according to claim 2, wherein diameters of the fibers are smaller adjacent said ink discharging portion than all other portions of said fibrous ink retaining member.

4. An apparatus according to claim 1, wherein contact portions between fibers are partly welded.

5. An ink jet apparatus according to claim 1, wherein an absolute value of a negative pressure produced by the fibers disposed adjacent the ink discharging portion is larger than a negative pressure produced by the fibers disposed at another portion.

6. A liquid container for supplying liquid to a recording head, comprising:

a liquid discharging portion for discharging the liquid to the recording head; and a fibrous material capable of retaining the liquid to be supplied to said liquid discharging portion;

wherein said fibrous material includes fibers having diameters which are smaller adjacent said liquid discharging portion than other portions of said fibrous material.

7. A container according to claim 6, wherein the fibers deform within a range of elastic deformation, and are crossed with one another at a plurality of positions.

8. A container according to claim 6, wherein the fibers are crossed at a plurality of positions, wherein the diameters adjacent the liquid discharging portion are 20 to 40 microns, and wherein diameters in the other portions are 50 to 100 microns.

9. A container according to claim 6, wherein said fibrous material has a first fibrous material portion of fibers having relatively small diameters, and has a second fibrous material portion of fibers having relatively larger diameters.

10. A container according to claim 6, wherein said fibrous materials include fibers having diameters which are larger at an inside portion thereof than at an outside portion.

11. A liquid container according to claim 6, wherein diameters of said fibers are smaller adjacent said liquid discharging portion than all other portions of said fibrous materials.

12. A liquid container according to claim 6, wherein contact portions between fibers are partly welded.

13. A liquid container according to claim 6, wherein an absolute value of a negative pressure produced by the fibers disposed adjacent the ink discharging portion is larger than a negative pressure produced by the fibers disposed at another portion.

* * * * *

UNITED STATES PATENT AND TRADEMARK OFFICE

CERTIFICATE OF CORRECTION

PATENT NO. : 6,137,512 
DATED : October 24, 2000
INVENTOR(S) : Masahiko Higuma et al.

It is certified that error appears in the above-identified patent and that said Letters Patent is hereby corrected as shown below:

Title page,
Item [*] "Notice: This patent issued on a continued prosecution application filed under 37 CFR 1.53(d) and is subject to the twenty year patent term provisions of 35 U.S.C. 154(a)(2)." should be deleted.

Item [56], References Cited, FOREIGN PATENT DOCUMENTS,
"02034353 should read -- 2-034353
4290752 4-290752
05008405 5-008405
05096742 5-096742
05104735" 5-104735 --; and
"06079882" should read -- 6-079882 --.

Column 1,
Line 18, "use" should read -- use the capillary force peculiar to porous material such --;
Line 19, "low" should read -- flow --;
Line 21, "atmosphere" should read -- atmospheric --;
Line 29, "amount of" should read -- amount of the ink, relative to the internal volume of --;
Line 36, "sponges" should read -- sponge --;
Line 54, "off" should read -- of --;
Line 66, "than" should read -- that --; and
Line 67, "bottommost" should read -- bottom-most --.

Column 2,
Line 3, "container" should read -- container, --;
Line 16, "(corresponding to European Appln." should be deleted;
Line 17, "562,733)" should be deleted; and "A structures" should read -- a structure --;
Line 23, "situation" should read -- invention, --;
Line 44, "deliver" should read -- delivery, the ink leak, and the like, which are --;
Line 52, "inter" should read -- internal --;
Line 53, "strands" should read -- strand arrangement relates to the way the fiber strands --;
Line 55, "invention" should read -- invention, --;
Line 56, "point;" should read -- point: --;
Line 60, "wall" should read -- internal wall --; and "the (second occurrence) should be deleted; and
Line 62, "preferably" should read -- preferable --.

UNITED STATES PATENT AND TRADEMARK OFFICE

CERTIFICATE OF CORRECTION

PATENT NO. : 6,137,512
DATED : October 24, 2000
INVENTOR(S) : Masahiko Higuma et al.

It is certified that error appears in the above-identified patent and that said Letters Patent is hereby corrected as shown below:

Column 3,
Line 4, "properties" should read -- property --;
Line 8, "in" should read -- is --; and
Line 37, "of" should read -- or --.

Column 4,
Line 3, "reliably" should read -- reliably the fibrous member in the container main body while --;
Line 16, "in" should read -- is --;
Line 48, "and" should be deleted; and
"an d" should read -- and --; and
Line 51, "intention" should read -- invention --.

Column 5,
Line 34, "describes" should read -- describe --;
Line 39, "describes an" should read -- describe the --;
Line 43, "a" should be deleted; and
"describes an" should read -- describe --;
Line 47, "a" should be deleted; and
"describes an" should read -- describe --;
Line 51, "a" should be deleted; and
"describes an" should read -- describe --;
Line 55, "a" should be deleted; and
"describes" should read -- describe --;
Line 56, "an" should be deleted;
Line 59, "a" should be deleted; and
"describes" should read -- describe --;
Line 60, "an" should be deleted; and
Line 64, "an" should be deleted.

Column 6,
Line 1, "an" should be deleted;
Line 5, "an" should be deleted;
Line 20, "that, is" should read -- that is --; and
Line 43, "causing" should read -- casing --.

Column 7,
Line 22, "will" should read -- until --; and
Line 29, "was" should be deleted.

UNITED STATES PATENT AND TRADEMARK OFFICE

CERTIFICATE OF CORRECTION

PATENT NO. : 6,137,512
DATED : October 24, 2000
INVENTOR(S) : Masahiko Higuma et al.

It is certified that error appears in the above-identified patent and that said Letters Patent is hereby corrected as shown below:

Column 8,
Line 20, "preferable;e" should read -- preferable --.

Column 9,
Line 34, "between the" should read -- between the volume of the fibrous member 4 and the volume of the --; and
Line 54, "strands" should read -- strands to lump together. As the fiber strands --.

Column 14,
Line 6, "insert" should read -- inset --.

Column 17,
Line 24, "amount. it" should read -- amount. It --; and
Line 55, "his" should read -- is --.

Column 23,
Line 8, "form" should read -- from --.

Signed and Sealed this

Twelfth Day of November, 2002

*Attest:*

*Attesting Officer*

JAMES E. ROGAN
*Director of the United States Patent and Trademark Office*